US006548964B2

(12) United States Patent
Kamata et al.

(10) Patent No.: US 6,548,964 B2
(45) Date of Patent: Apr. 15, 2003

(54) DISCHARGE LAMP LIGHTING APPARATUS AND LUMINAIRE USING THE SAME

(75) Inventors: Masahiko Kamata, Kanagawa-ken (JP); Keiichi Shimizu, Kanagawa-ken (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 0 days.

(21) Appl. No.: 10/107,296

(22) Filed: Mar. 28, 2002

(65) Prior Publication Data

US 2002/0140376 A1 Oct. 3, 2002

(30) Foreign Application Priority Data

Mar. 28, 2001 (JP) ..... 2001-092737
Jan. 31, 2002 (JP) ..... 2002-024813

(51) Int. Cl.[7] ..... H05B 37/02

(52) U.S. Cl. ..... 315/209 R; 315/219; 315/291; 315/224; 315/307; 315/DIG. 7

(58) Field of Search ..... 315/209 R, 291, 315/224, 276, 307, DIG. 5, DIG. 7

(56) References Cited

U.S. PATENT DOCUMENTS 4,559,478 A * 12/1985 Fuller et al. ..... 315/224
5,453,665 A * 9/1995 Konopka ..... 315/219
5,798,616 A * 8/1998 Takehara et al. ..... 315/247
5,872,430 A * 2/1999 Konopka ..... 315/219
5,936,360 A * 8/1999 Kaneko ..... 315/307
6,144,173 A * 11/2000 Nerone ..... 315/291
6,472,827 B1 * 10/2002 Nilssen ..... 315/209 R

* cited by examiner

*Primary Examiner*—Don Wong
*Assistant Examiner*—Ephrem Alemu
(74) *Attorney, Agent, or Firm*—Pillsbury Winthrop LLP

(57) ABSTRACT

A discharge lamp lighting apparatus has a DC power supply, generating a direct current voltage, an inverter circuit, switching the direct current voltage at a high frequency, and including one bipolar transistor, which is turned on by a feedback signal of the high frequency voltage and turned off by an off-switching signal of a control circuit, and a resonance circuit resonated by the switching operations, a discharge lamp, operated by the high frequency voltage, and the control circuit, provided with a timer regulating operation modes of the discharge lamp, and an oscillator generating the off-switching signal according to each operation mode of the discharge lamp.

9 Claims, 16 Drawing Sheets

DISCHARGE LAMP LIGHTING APPARATUS AND LUMINAIRE USING THE SAME

FIELD OF THE INVENTION

The present invention relates to a discharge lamp lighting apparatus for lighting a discharge lamp at a high frequency using a single-transistor voltage resonance inverter. Moreover, the present invention relates to a luminaire using the discharge lamp lighting apparatus.

BACKGROUND OF THE INVENTION

A so-called electronic type discharge lamp lighting apparatus wherein a discharge lamp is lighted at a high frequency is now being propagated. Conventionally, a bipolar transistor which is a current drive type switching element has been used for a switching element of a high-frequency inverter which principally constitute the electronic type discharge lamp lighting apparatus. However, a MOSFET which is of a voltage drive type switching element is able to be used recently. Therefore, integrated circuits are widely used as a drive circuit of the switching element. By integrating the drive circuit in a chip, not only the installation of the discharge lamp becomes easy, but also it is able to miniaturize a wiring board and the discharge lamp lighting apparatus.

However, since the high voltage proof MOSFET has a high ON-state resistance, there is a characteristic problem such as a large conduction loss. Therefore, MOSFET is widely used in an inverter like a half-bridge type inverter which can be used at a relatively low voltage.

Accordingly, the bipolar transistor is used for a single-transistor voltage resonance inverter for which a high voltage proof is required. In this case, the switching operation of the bipolar transistor is performed by current feedback using a saturable transformer.

However, the saturable transformer has a drawback of a wide dispersion in characteristics. So, it is difficult to control the quality of the saturable transformer. Moreover, the saturable transformer has another drawback of a wide dispersion in temperature characteristics. Accordingly, a single-transistor voltage resonance inverter had a problem of difficult to design.

When a control circuit suitable for the single-transistor voltage resonance inverter using a bipolar transistor is constituted of an integrated circuit, sufficient base current have to be supplied to the bipolar transistor of the current drive type. Thus, the integrated circuit became upsizing, and the integration was difficult in fact.

SUMMARY OF THE INVENTION

The present invention has an object to provide a discharge lamp lighting apparatus principally constituted by a single-transistor voltage resonance inverter using a bipolar transistor, and further, the principal part of its control circuit is constituted by a small integrated circuit. Furthermore, the present invention has another object to provide a luminaire using the discharge lamp lighting apparatus.

In addition, the present invention has another object to provide a discharge lamp lighting apparatus and a luminaire using the lamp system which perform the turn-on operation of the bipolar transistor of the single-transistor voltage resonance inverter effectively.

Furthermore, the present invention has other object to provide a discharge lamp lighting apparatus and a luminaire using the lighting device which start a single-transistor voltage resonance inverter effectively.

To achieve an object of the present invention, a first aspect of the discharge lamp lighting apparatus includes a DC power supply, generating a direct current voltage, an inverter circuit, switching the direct current voltage at a high frequency, and including one bipolar transistor, which is turned on by a feedback signal of the high frequency voltage and turned off by an off-switching signal of a control circuit, and a resonance circuit resonated by the switching operations, a discharge lamp, operated by the high frequency voltage, and the control circuit, provided with a timer, which determines operation-durations including a preheating mode, a starting mode and a lighting mode of the discharge lamp, and an oscillator generating the off-switching signal according to the each mode.

In descriptions of the first aspect and other aspects of the discharge lamp lighting apparatus, some definitions and their technical meanings are presented for following specific terms, unless otherwise specified.

<First DC Power Supply>

A first DC power supply is a power source for supplying an electric energy to energizing at least a single-transistor voltage resonance inverter and a discharge lamp. The first DC power supply supplies electrical energy straightforwardly to the single-transistor voltage resonance inverter. The first DC power supply may be any one of a battery power source and a rectified DC power supply. In case of a rectified DC power supply, a voltage of a low-frequency AC power source, for instance, of a commercial AC power source is rectified in order to obtain a DC voltage.

Further, the rectified DC power supply can contain a smoothing circuit as needed. A smoothing circuit may be any of a passive filter containing a partial smoothing circuit wherein a smoothing capacitor is simply coupled across the DC output terminals, a partial smoothing circuit as described below and an active filter such as a chopper. In addition, the partial smoothing circuit is provided with at least a capacitor and a diode, and it outputs a DC output having a rectified waveform of half wave whose valley is filled with a DC voltage up to the middle level. By using an active filter, an input current is enhanced in its power-factor and suppressed in its harmonics. In addition, in order to enhance the power-factor and suppress harmonics of the input current, the single-transistor voltage resonance inverter may be used further to obtain a smoothing DC voltage by using a high-frequency switching operation of the bipolar transistor of the single-transistor voltage resonance inverter.

Furthermore, a first DC power supply can also supply the operating power to the control circuit.

<Single-Transistor Voltage Resonance Inverter>

A single-transistor voltage resonance inverter is provided with a single switching element and a resonance circuit where the switching element is coupled to the first DC power supply. The signal-transistor voltage resonance inverter performs the inverter operation for generating a sinusoidal wave AC voltage in the resonance circuit by the switching operation of the switching element turning on and off. Here, the "one switching transistor" means that it can be considered a single switching element functionally. Therefore, it may be provided with two or more switching elements coupled in parallel at the point of current capacity.

Further, the first aspect of the discharge lamp lighting apparatus is provided with a bipolar transistor as a switching element of the single-transistor voltage resonance inverter. The turn-on switching operation of the switching element is performed by the feedback control to flow a current to a base of the bipolar transistor. The feedback control is for performing a current feedback of any of a collector current and a resonance current or a lamp current flowing in the resonance circuit, or for performing a voltage feedback of a voltage drop of a current-limiting reactor. Here, the turn-off switching operation of the switching element is performed by using a control circuit. Further, in order to perform the turn-off switching operation easily, it can be provided with a base current cut-off device for short-circuiting between the base and emitter of the bipolar transistor.

Furthermore, a high frequency current can be took out of a secondary winding when the inductor of the resonance circuit is constituted by a primary winding for instance, or a it can lead the voltage drop of the inductor electrically. Here, in the description of the first aspect of the discharge lamp lighting apparatus, the term "high frequency" means the frequency of around 10 KHz, and more preferably, between 40 KHz to 500 KHz. If the frequency is 10 KHz or more, it realize a lighting device of the discharge lamp which is compact in size and light in weight, and improves the lamp efficiency. Further, if the frequency is from 40 KHz to 500 KHz, it is able to reduce the switching loss and cost of the bipolar transistor.

<Discharge Lamp>

It is essential only that a discharge lamp is provided with a pair of filament, so it may have any constitution such as a fluorescent lamp or a bactericidal lamp. The pair of filament electrode is preheated by the high frequency current output from the single-transistor voltage resonance inverter, and the discharge lamp is started and lighted by the high frequency current output from the single-transistor voltage resonance inverter.

In order to light the discharge lamp stably, it is required to connect a current limiting impedance element to the discharge lamp in series. As a current limiting impedance element, it may be any of an inductor, a capacitor, and a resistor. However, an inductor is suitable as a current limiting impedance element.

A single or plural discharge lamps are coupled to the single-transistor voltage resonance inverter. Plural of discharge lamps are coupled in series, in parallel, or in series parallel. Here, in case of coupling the discharge lamps in parallel, the current limiting impedance element is coupled to the discharge lamp in series in each parallel circuit.

In order to heat the filament electrode of the discharge lamp, either one of or both of a filament preheating capacitor circuit and a filament transformer are used. Here, the filament preheating capacitor circuit is a circuit where the capacitor is coupled to the discharge lamp in parallel, and it forms a series resonance circuit with a current-limiting reactor, further it is coupled to at least one of the filament electrodes in series. Moreover, as a filament transformer, a filament heating winding is magnetically coupled to the inductor or the current-limiting reactor of the resonance circuit, or a filament transformer is mounted separately from the single-transistor voltage resonance inverter.

<Control Circuit>

A control circuit is a circuit for controlling a turn-off switching operation principally of the single-transition resonance circuit inverter. In the first aspect of the discharge lamp lighting apparatus, the control circuit is constituted principally by an integrated circuit. The control circuit contains a timer and an oscillator. The timer states at power-on to determine at least operation-durations of the preheating mode and the starting mode. The oscillator controls the switching operation of the bipolar transistor of the single-transistor voltage resonance inverter by generating the off-switching signal having cycles suiting the preheating mode, starting mode, and lighting mode at least. Here, the term "the operation-duration of the starting mode" means a period for operating the single-transistor voltage resonance inverter in the starting mode. If the discharge lamp is lighted within the period, the lighting of the discharge lamp is detected by a lighting detecting circuit so as to continue the inverter operation. However, when the discharge lamp is not lighted within the period of the starting mode for some reasons, the inverter operation is stopped simultaneously at the end of the starting mode. The inverter operation is stopped by controlling the oscillator for instance.

The timer determines the operation-duration of the oscillator suiting the operation mode. Further, the timer may be constituted to control the cycle, which is the timing of the high level and low level of the off-switching signal generated from the oscillator. Furthermore, the timer may be provided with a time-constant circuit. In this case, the time-constant circuit can be installed external to the integrated circuit in order to easily set up the operation-duration desirably according to the specification.

The oscillator generates an off-switching signal having a cycle suiting the operation mode for a predetermined operation-duration for each operation mode by the timer. In order to generate the off-switching signal, two or more circuits for determining the on-duration or the off-duration of the off-switching signal generated in the oscillator are mounted for each operation mode, and one of them is selected corresponding to the operation mode. Further, in order to fix the on-duration or the off-duration of the off-switching signal, circuits for determining these durations can be constituted by a common single circuit. In this case, for instance, a capacitor charging resistor and two or more capacitor discharging resistors are mounted separately to the capacitor for determining the frequency of the off-switching signal. Thus, the off timing of each period of the off-switching signal is determined by the resistance of the capacitor charging resistor, on the other hand, the on-timing of each period of the off-switching signal is determined by the resistance of the capacitor discharging resistor. Here, two or more capacitor discharging resistors are constituted to have different resistances according to the periods of the off-switching signal required for the operation modes. In the above configuration, according to install the capacitor for determining the timing, the capacitor charging resistor, and a capacitor discharging resistor external to the integrated circuit, the on-duration or the off-duration of the off-switching signal are setup easily desirably according to the specification.

Further, the control circuit can set up other operation modes besides the preheating, starting, and lighting modes. For instance, when a modulated light level control circuit is included in the integrated circuit, the period of the off-switching signal can be controlled to be a period suitable for modulating light by receiving the modulated light signal from outside. Here, the modulated light may be any of continuous modulated light and gradual modulated light.

Furthermore, the integrated circuit of the control circuit includes an input voltage fluctuation compensation circuit. That is, when using a rectified DC power supply, it is practically important to cope with a fluctuation of the commercial AC power source voltage not to affect to the operation of the discharge lamp as much as possible. The input voltage fluctuation compensation circuit is one of the countermeasures, and it is able to avoid or reduce the effect caused by the fluctuation of the commercial AC power source voltage. Here, since the input voltage fluctuation affects little to the operation of the discharge lamp during the preheating mode, the input voltage fluctuation compensation circuit can be suspended. Furthermore, the input voltage fluctuation compensation circuit can operated only during the lighting mode. Accordingly, the circuit configuration of the integrated circuit is simplified.

Moreover, a the integrated circuit of the control circuit includes a high frequency current stabilizing circuit. The high frequency current stabilizing circuit operates to stabilize the high frequency current by feeding back the current flowing in the single-transistor voltage resonance inverter or the discharge lamp during the lighting operation of the discharge lamp.

<Operations>

In the first aspect of the discharge lamp lighting apparatus, the timer of the control circuit determines the operation-durations set up beforehand in response to each operation mode of at least preheating, starting, and lighting of the discharge lamp. Thus, it is able to allow optimum periods for every operation modes suiting the discharge lamp characteristics. Accordingly, the life of the discharge lamp is not interfered because of the improper operation-duration.

Further, the oscillator generates an off-switching signal having a cycle that is set up for each operation mode by interlocking with the determination of the operation-duration of each operation mode. Therefore, it is able to supply the high frequency current suitable for each operation mode to the discharge lamp.

Furthermore, since the switching frequency is appropriately controlled by the control circuit, not only the influence on the temperature characteristics etc. becomes small, but also it becomes easy to integrate the inverter in a chip.

Moreover, the single-transistor resonance inverter can be provided with a bipolar transistor which has a high voltage proof property and a characteristic problem free property for a switching element. Since the turn-on switching operation of the bipolar transistor is controlled by using the feedback signal, and the turn-off switching operation of it is controlled by using the off-switching signal generated from the oscillator, the switching operation of the bipolar transistor is controlled effectively even though the principal part of the control circuit is integrated in a chip.

Furthermore, by integrating the principal part of the control circuit in a chip, it easily integrates a protection circuit to the abnormal condition caused at the life terminal, an input voltage fluctuation compensation circuit, or a high frequency current stabilizing circuit, so that it is able to realize various functions control.

Furthermore, by integrating the principal part of the control circuit in a chip, the circuit installation of the discharge lamp becomes easy, it is able to realize a discharge lamp whose circuit board is compact in size and light in weight.

To achieve an object of the present invention, a second aspect of the discharge lamp lighting apparatus includes a DC power supply, generating a direct current voltage, an inverter circuit, switching the direct current voltage at a high frequency, and including one bipolar transistor, which is turned on by a feedback signal of the high frequency voltage and turned off by an off-switching signal of a control circuit, and a resonance circuit resonated by the switching operations, a discharge lamp, operated by the high frequency voltage, a current transformer, feeding back a lamp current of the discharge lamp to turn on the bipolar transistor, a base current cut-off device responsive to the off-switching signal of the control circuit to cut off a base current of the bipolar transistor, and the control circuit, provided with a timer and an oscillator, wherein the timer determines operation-durations including a preheating mode, a starting mode and a lighting mode of the discharge lamp, and supplies a starting current to the bipolar transistor, and the oscillator provides the base current cut-off device with the off-switching signal which varies to regulate an on-duration of the base current cut-off device according to the each mode.

The second aspect of the discharge lamp lighting apparatus is configured to turns on the bipolar transistor that is a switching element of the single-transistor voltage resonance inverter effectively. That is, when the power is turned on, a starting current is applied to the bipolar transistor from the control circuit so as to apply timing for turning on to the bipolar transistor. Then, the current flows to the resonance circuit of the single-transistor voltage resonance inverter, thus, the bipolar transistor is started and the discharge lamp is lighted. When the discharge lamp is lighted, as the result of the current being fed back to the base of the bipolar transistor by the current feedback circuit, the operation of the single-transistor voltage resonance inverter is shifted to the regular operation. Consequently, the lighting of the discharge lamp is performed smoothly. Here, the turn-on operation of each cycle during the regular operation is performed by the current supplied from the current feedback circuit.

In addition, when the primary winding of the current transformer of the current feedback circuit is coupled to the collector of the bipolar transistor of the single-transistor voltage resonance inverter in series, the current does not flow to the current transformer unless the bipolar transistor is turns on. Therefore, there is a drawback that the current feedback circuit does not contribute to the turn-on operation of the bipolar transistor.

By the way, in the single-transistor voltage resonance inverter, there are two factors to turn on the bipolar transistor in each cycle. The one factor is a current supplied from a current feedback circuit. The other factor is a resonance current which flows from the base to the collector during the off-duration of the bipolar transistor. In the latter, when the resonance current flows from the base to the collector, the electron which is a minority carrier will be accumulated in a base region. Then, when the polarity of the resonance current is reversed, and the positive voltage is applied to the collector, the current flows from the collector to the based in order to emit the minority carrier accumulated in the base region. At this time, a part of the current flows also to an emitter. Therefore, also in the configuration in which the primary winding of the current transformer is connected to the collector of the bipolar transistor, the turn-off operation of each cycle is performed effectively by the current flows from the collector to the emitter associating with the emission of the minority carrier accumulated in the base region when the polarity of a resonance current is reversed. However, since there is a possibility that the base collector current does not flow in the situation where the power supply voltage and the lighting condition of the discharge lamp, the turn-on operation of each cycle is performed by the starting current from the control circuit under this condition.

However, the starting current obtained from the control circuit is about several mAs, and is a small value when it is compared with the current obtained from the current feedback circuit. Thus, since the turn-operation performed by a small starting current is influenced by the capacity component between base and emitter greatly, the timing of the turn-on operation is delayed, and it may worsen the switching operation.

Then, in the second aspect of the discharge lamp lighting apparatus, the primary winding of the current transformer in the current feedback circuit is connected in the current path of the discharge lamp. As the result, the bipolar transistor is certainly turned on in each cycle by the current supplied from the current feedback circuit. Here, the term "the current path of the discharge lamp" means the passage of a current which influences directly to a load current or a load current which flows to the discharge lamp. Therefore, for instance, when the output transformer is intervened between the bipolar transistor of the single-transistor voltage resonance inverter and a discharge lamp, the primary winding of the current transformer may be connected directly in the secondary side circuit of the output transformer, or it may be connected directly in the primary side circuit of the output transformer.

Furthermore, there is the necessity that a phase of the current fed back from the secondary winding of the current transformer to the base circuit of the bipolar transistor is adjusted to a phase of the load current in a predetermined relation. In order to perform this adjustment appropriately, a phase matching circuit can be interposed between the secondary winding of the current transformer and the base circuit of the bipolar transistor. The phase matching circuit may adopt a constitution according to the position for inserting the primary winding of the current transformer as needed.

Then, in the second aspect of the discharge lamp lighting apparatus, the run-on operation of each cycle of the bipolar transistor in the single-transistor voltage resonance inverter is performed by the current supplied to the base form the secondary winding of the current transformer, since the primary winding of the current transformer in the current feedback circuit is connected in the current path of the discharge lamp. Therefore, a turn-on operation of the bipolar transistor is performed with reliability and stability.

Furthermore, the turn-off operation of the bipolar transistor is performed by short-circuiting a base current by the base current cut-off device, when the off-switching signal generated from the control circuit is an on-duration. Although the on-duration of the off-switching signal is fixed, the off-duration varies according to a control pattern as needed. When the off-switching signal is low in level, the base current cut-off device will be in an open state. Therefore, when the current is fed back from the current transformer to the base, the bipolar transistor is turned off.

To achieve an object of the present invention, a third aspect of the discharge lamp lighting apparatus includes a first DC power supply, generating a first direct current voltage, an inverter circuit, switching the first direct current voltage at a high frequency, and including one bipolar transistor, which is turned on by a feedback signal of the high frequency voltage and turned off by an off-switching signal of a control circuit, and a resonance circuit resonated by the switching operations, a discharge lamp, operated by the high frequency voltage, a base current cut-off device responsive to the off-switching signal of the control circuit to cut off a base current of the bipolar transistor, a starting current controller, controlling a second direct current voltage supplied from a second DC power supply provided in the control circuit to the base of the bipolar transistor for a predetermined period in a starting operation, and the control circuit, provided with an oscillator defining the high frequency for operating the inverter and regulating the frequency of the off-switching signal.

The third aspect of the discharge lamp lighting apparatus is so configured that the starting current flows only when necessary.

The starting current for starting the bipolar transistor that is a switching element of the inverter is supplied to the base of the bipolar transistor via a current limiting resistor from a rectified DC power supply or a reference potential source constituted in the control circuit in general. In the inverter providing the current feedback circuit, the current is fed back to the base of the bipolar transistor by the current feedback circuit after it is started. Therefore, the regular operation is performed continuously.

However, in a non-load state where the discharge lamp is not installed in the load circuit, the load circuit is opened. Therefore, even if there is the current feedback circuit, current is not fed back to the base of the bipolar transistor. However, it is possible to turn on the bipolar transistor without depending on the current feedback to its base from a current feedback circuit. That is, as mentioned above, when the resonance current flows to the collector from the base, the electron which is a minority carrier will be accumulated in a base region. Then, when the polarity of the resonance current is reversed, and the positive voltage is applied to the collector, the current flows from the collector to the based in order to emit the minority carrier accumulated in the base region. Thus, the bipolar transistor is turned on.

In the single-transistor voltage resonance inverter of a self-oscillation control system, the frequency will not be appropriately controlled, and the operation frequency will be lowered when it becomes the oscillation state in the non-load state. Therefore, the resonance voltage rises to exceed the pressure proof of the bipolar transistor, thus the bipolar transistor is destroyed. Moreover, in the single-transistor voltage resonance inverter of a fixed frequency control system, the resonance frequency lowers when it becomes the non-load state, and time width of the resonance voltage is expanded. As the result, the bipolar transistor is turned on by the starting current before the collector voltage lowers up to 0 V, thus, the null voltage switching operation will not be performed. Therefore, the switching loss of the bipolar transistor is increased, and there is a case that the bipolar transistor is destroyed. That is, in the single-transistor voltage resonance inverter of either the self-oscillation control system or the fixed frequency control system, there is a case that the bipolar transistor is destroyed when it is in the non-loaded state.

Next, referring now to the attached drawings, FIGS. 12*a* to 12*d* and FIGS. 13*a* and 13*b*, it will explained that the reasons to increase the switching loss by the oscillation in the non-load state, and thus the switching loss causes to destroy the bipolar transistor.

FIGS. 12*a* to 12*d* are waveform diagrams showing the voltage and current waveform of each portion of the single-transistor voltage resonance inverter. FIG. 12*a* is a waveform diagram showing the waveform of a collector-emitter voltage VCE. FIG. 12*b* is a waveform diagram showing a current waveform of a collector current IC. FIG. 12*c* is a waveform diagram showing a current waveform of a base current IB. FIG. 12*d* is a waveform diagram showing a voltage waveform of a voltage between the base and emitter VBE. FIGS. 13*a* and 13*b* are enlarged diagrams of a current waveforms of the voltage waveform of the voltage across and through the collector-emitter VCE shown in FIG. 12*a* and a current waveform of the collector current IC shown in FIG. 12*b*.

Especially, as seen from FIG. 13*b*, a collector current flows though it is small in the non-load state as shown by an arrow shows. Therefore, the operation of the bipolar transistor becomes class A operation during the period. Thus, the switching loss applied by "collector-emitter voltage VCE× collector-current IC" occurs in a bipolar transistor. Therefore, if the starting current continues flowing in the non-load state, the switching loss will increase and the bipolar transistor is destroyed. In order to solve this problem, it is effective to limit the starting current and to control the loss of the transistor. However, when the starting current is lowered, there will be a problem to lower the starting function which is the essential function of the starting circuit.

Then, the third aspect of the discharge lamp lighting apparatus is configured that the starting current is supplied to the base of the bipolar transistor only within the predetermined time at the time of starting operation. That is, the second DC power supply for supplying the current to the vase circuit of the bipolar transistor of the switching element is mounted on the control circuit of the single-transistor voltage resonance inverter. Furthermore, a starting current controller for controlling to supply the base current only within the predetermined time at the time of the starting operation is interposed between the second DC power supply and the base circuit of the bipolar transistor. As the starting current controller, if it satisfies the conditions mentioned above, the concrete configuration of it will not be asked. For example, a starting current controller is able to be provided with a differentiating circuit or a switch which is timer-controlled. Here, the starting current below necessary quantity may flow continuously. Moreover, the second DC power supply may have a current capacity to the extent of supplying the base current to the bipolar transistor. Therefore, when the principal part of the control circuit is integrated in a chip, the constant voltage power source is mounted in the integrated circuit.

In the third aspect of the discharge lamp lighting apparatus, it can be started by supplying the starting current to the base of the bipolar transistor only within the predetermined time at the starting operation. Therefore, the starting characteristics is not lowered. Furthermore, the destruction of the bipolar transistor caused by increase of the switching loss which originates in the starting current at the time of the oscillation in a no-load state is prevented.

To achieve an object of the present invention, a fourth aspect of the discharge lamp lighting apparatus includes a DC power supply, generating a direct current voltage, an inverter circuit, switching the direct current voltage at a high frequency, and including one bipolar transistor, which is turned on by a feedback signal of the high frequency voltage and turned off by an off-switching signal of a control circuit, and a resonance circuit resonated by the switching operations, a discharge lamp, operated by the high frequency voltage, and the control circuit, provided with a timer regulating operation modes of the discharge lamp, and an oscillator generating the off-switching signal according to each operation mode of the discharge lamp.

The forth aspect of the discharge lamp lighting apparatus is configured to suitably carries out a turn-off switching operation of the bipolar transistor in the single-transistor voltage resonance inverter. That is, a control circuit contains a timer and an oscillator. The timer determines the time for operating the oscillator as needed. Moreover, an oscillator generates an off-switching signal. The turn-off switching operation of the bipolar transistor is controlled by the off-switching signal.

In the fourth aspect of the discharge lamp lighting apparatus, the control circuit contains a timer and an oscillator, and the turn-off switching operation of the bipolar transistor in the single-transistor voltage resonance inverter is controlled by the timer and the oscillator. Therefore, the control of the turn-off switching operation is performed with reliability and a circuit configuration is simplified.

Further to the fourth aspect of the discharge lamp lighting apparatus, in a fifth aspect of the discharge lamp lighting apparatus, the control circuit is provided with a lamp life terminal detecting circuit for detecting the life terminal of the discharge lamp, a lamp installation detecting circuit for detecting the installation of the discharge lamp, a lamp life terminal determining circuit for determining the life terminal in response to the output of the lamp life terminal detecting circuit, a lamp installation determining circuit for determining the lamp installation in response to the output of the lamp installation detecting circuit, and wherein it is characterized by that the control circuit carries out a protective action when a lamp life terminal is determined, and releases the protective action when a lamp installation is determined.

The fifth aspect of the discharge lamp lighting apparatus is configured to accommodate a circuit for carrying out a protective action by detecting a lamp life terminal and a circuit for releasing the protective action when the lamp installation is detected.

<Lamp Life Terminal Detecting Circuit>

When the discharge lamp comes to the life terminal, its discharge becomes a half-discharge, and the DC component is superimposed on the lamp current. Therefore, by detecting the DC component, the life terminal of the discharge lamp is easily detected. In addition, the lamp life terminal detecting circuit may be any configuration if it is a circuit for detecting the life terminal of the discharge lamp.

<Lamp Installation Detecting Circuit>

When the discharge lamp is installed on correctly, the single-transistor voltage resonance inverter is in a loaded state. Moreover, when the discharge lamp is not installed on correctly, the single-transistor voltage resonance inverter is in a non-loaded state. Therefore, the lamp installation is detected by detecting the extent of the load. Here, the lamp installation detecting circuit may be any configuration only if it is a circuit for detecting the installation of the discharge lamp. In this case, it is able to detect the extent of the lamp installation by determining the extent of the load.

<Circuit Integration>

In the integrated circuit, a lamp life terminal determining circuit and a lamp installation determining circuit are integrated further to the principal part of the control circuit explained in the first embodiment. The lamp life terminal determining circuit determines the lamp life terminal according to the output of the lamp life terminal detecting circuit, so as to perform the protective action. The lamp installation determining circuit determines the lamp installation according to the output of the lamp installation detecting circuit. As a protective action, for instance, the operation of the single-transistor voltage resonance inverter is forced to stop. Here, if the lamp determined the life terminal is replaced for a good lamp, the protective action is released in response to the lamp replacement, thus the operation of the discharge lamp lighting apparatus is reset to the original operation automatically.

<Operation>

In the fifth aspect of the discharge lamp lighting apparatus, when the discharge lamp comes to the life terminal, the lamp life terminal detecting circuit detects the life terminal of the discharge lamp. If the lamp life terminal is detected, the lamp life terminal determining circuit integrated in the integrated circuit determines the lamp life terminal. Then, the lamp life terminal determining circuit determines that the discharge lamp is in the terminal stage where it needs the protective action, the lamp life terminal determining circuit, for instance, generates a shut-down signal to shut-down the operation of the single-transistor voltage resonance inverter compulsorily in order to perform the protective action. When the lamp installation detecting circuit detects the replacement of the lamp in the life terminal for a good lamp, the protective action is released by the lamp installation determining circuit in accordance with the detection, thus the inverter operation is reset. Accordingly, since it is provided with a function for releasing the protective action when the active lamp determined the life terminal is replaced to a good lamp, the discharge lamp can be lighted safely again automatically even though the power source is not powered-on again.

Here, even when the discharge lamp is not installed perfectly, the protective action is performed by detecting the insufficient installation. In this case, the insufficient installation of the discharge lamp is detected in the lamp installation detecting circuit. Then, the lamp installation determining circuit generates a shut-down signal to shut-down the operation of the single-transistor voltage resonance inverter operation compulsorily in order to perform the protective action in according to the detection of insufficient installation.

As the result, it is able to ensure safety of the discharge lamp lighting apparatus.

Further to the fourth aspect of the discharge lamp lighting apparatus, a sixth aspect of the discharge lamp lighting apparatus is characterized by that the off-switching signal consists of an on-duration and an off-duration, and that the control circuit controls a frequency of the off-switching signal by regulating the off-duration of the off-switching signal while leaving the on-duration of the off-switching signal constant.

The sixth aspect of the discharge lamp lighting apparatus is configured to easily carry out a turn-off switching operation of the bipolar transistor. That is, a base current cut-off device, for instance a MOSFET having small current capacity is coupled between the base and the emitter of the bipolar transistor. If it is constituted that the base and the emitter is short-circuited when the electric switch is turned on in order to perform the off switching operation of the bipolar transistor, the circuit arrangement of the single-transistor voltage resonance inverter is relatively simplified. According to the sixth aspect of the discharge lamp lighting apparatus, the turn-off switching operation of the bipolar transistor is able to be performed certainly by only applying the off-switching signal to the single-transistor voltage resonance inverter having such a circuit arrangement. Further, while the off-switching signal is kept in the on-duration, the bipolar transistor is kept being turned of.

After the off-switching signal is not in the high-level state, and the base current cut-off device is turned off, the current flows from the current transformer to the base of the bipolar transistor, so that the bipolar transistor is turned on.

By repeating above mentioned off and on switching operations of the bipolar transistor, the single-transistor voltage resonance inverter performs the inverter operation. As the result, the generated AC output is supplied to the discharge lamp. Further, the off-duration of the off-switching signal varies, the cycle of the off-switching signal varies, and then the oscillation frequency also varies. According to the change of the oscillation frequency, the operation frequency of the single-transistor voltage resonance inverter changes. As the result, the frequency of the resonance circuit decreases, while the high frequency output current increases. Therefore, by selecting the operation frequency according to the operation mode of the discharge lamp, the preheating, the starting, and the lighting of the discharge lamp can be optimized.

As mentioned above, in the sixth aspect of the discharge lamp lighting apparatus, the circuit arrangement is simplified for performing the off switching operation of the bipolar transistor in the single-transistor voltage resonance inverter. Further to the fourth aspect of the discharge lamp lighting apparatus, a seventh aspect of the discharge lamp lighting apparatus is characterized by that the frequency of the off-switching signal is determined by an external device to the control circuit.

The seventh aspect of the discharge lamp lighting apparatus is configured to suitably integrate the control circuit which can be used for various discharge lamps in common in a chip. That is, there are different demands to the cycle of the off-switching signal generated from the oscillator depends on the discharge lamp or the way to control of the discharge lamp in general. In the seventh aspect of the discharge lamp lighting apparatus, a circuit device involved in deciding a cycle of the off-switching signal is constituted to be integrated externally. Therefore, the integrated circuit is able to be shared to the equipment of different specification only by changing the external device for a required one, or only by changing the capacitance or the resistance of the external device.

To achieve an object of the present invention, a eighth aspect of the discharge lamp lighting apparatus includes a DC power supply, generating a direct current voltage, an inverter circuit, switching the direct current voltage at a high frequency, and including one bipolar transistor, which is turned on by a feedback signal of the high frequency voltage and turned off by an off-switching signal of a control circuit, and a resonance circuit resonated by the switching operations, a discharge lamp, operated by the high frequency voltage, a current transformer, having a primary winding of the transformer inserted in a current path of the discharge lamp and a secondary winding inserted in a base current path of the bipolar transistor, thereby feeding back a lamp current of the discharge lamp to the base of the bipolar transistor to turn on the bipolar transistor through the primary winding and the secondary winding, a base current cut-off device responsive to the off-switching signal of the control circuit to cut off a base current of the bipolar transistor, and the control circuit, provided with a timer regulating operation modes of the discharge lamp, and an oscillator providing the base current cut-off device with the off-switching signal which varies in its frequency to regulate an on-duration of the base current cut-off device according to the operation mode of the discharge lamp.

The eighth aspect of the discharge lamp lighting apparatus is configured to favorably carries out the turn-on operation of the bipolar transistor which is a switching element of the single-transistor voltage resonance inverter effectively. The eighth aspect of the discharge lamp lighting apparatus differs from the second aspect of the discharge lamp lighting apparatus by that the requirements for the control circuit are simplified. That is, the timer controls the operation-duration of the oscillator as needed. On the other hand, the fifth embodiment is same as the second embodiment in that the oscillator generates the off-switching signal in response to the control of the timer.

In the eighth aspect of the discharge lamp lighting apparatus, the ON of the base current cut-off device varies according to the control pattern as needed. Therefore, it is able to turn on the bipolar transistor certainly in response to the timing of the applied current via the current transformer.

Further, the base current cut-off device is turned on by the off-switching signal applied from the control circuit, and the base current is short-circuited, so that the bipolar transistor is turned off.

To achieve an object of the present invention, a luminaire includes a body, and a discharge lamp lighting apparatus, as defined in the fourth aspect of the invention, mounted on the body.

In the ninth aspect of the invention, the term "luminaire " has a wide concept including any devices for utilizing light radiated from the discharge lamp. That is, the luminaire according to the present invention is such as a lighting unit, an image readout device, a display device, an ultraviolet rays generating device, and a screw-base-mount type fluorescent lamp in specific.

Furthermore, the body means a whole portion of the luminaire except the discharge lamp lighting apparatus. A lighting circuit potion of the discharge lamp lighting apparatus is able to be mounted separately from the body.

Additional objects and advantages of the present invention will be apparent to persons skilled in the art from a study of the following description and the accompanying drawings, which are hereby incorporated in and constitute a part of this specification.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Referring now to the attached drawings, FIGS. 1 to 10 and FIGS. 14 and 15, some embodiments of the present invention will be explained hereinafter.

Figure 1:
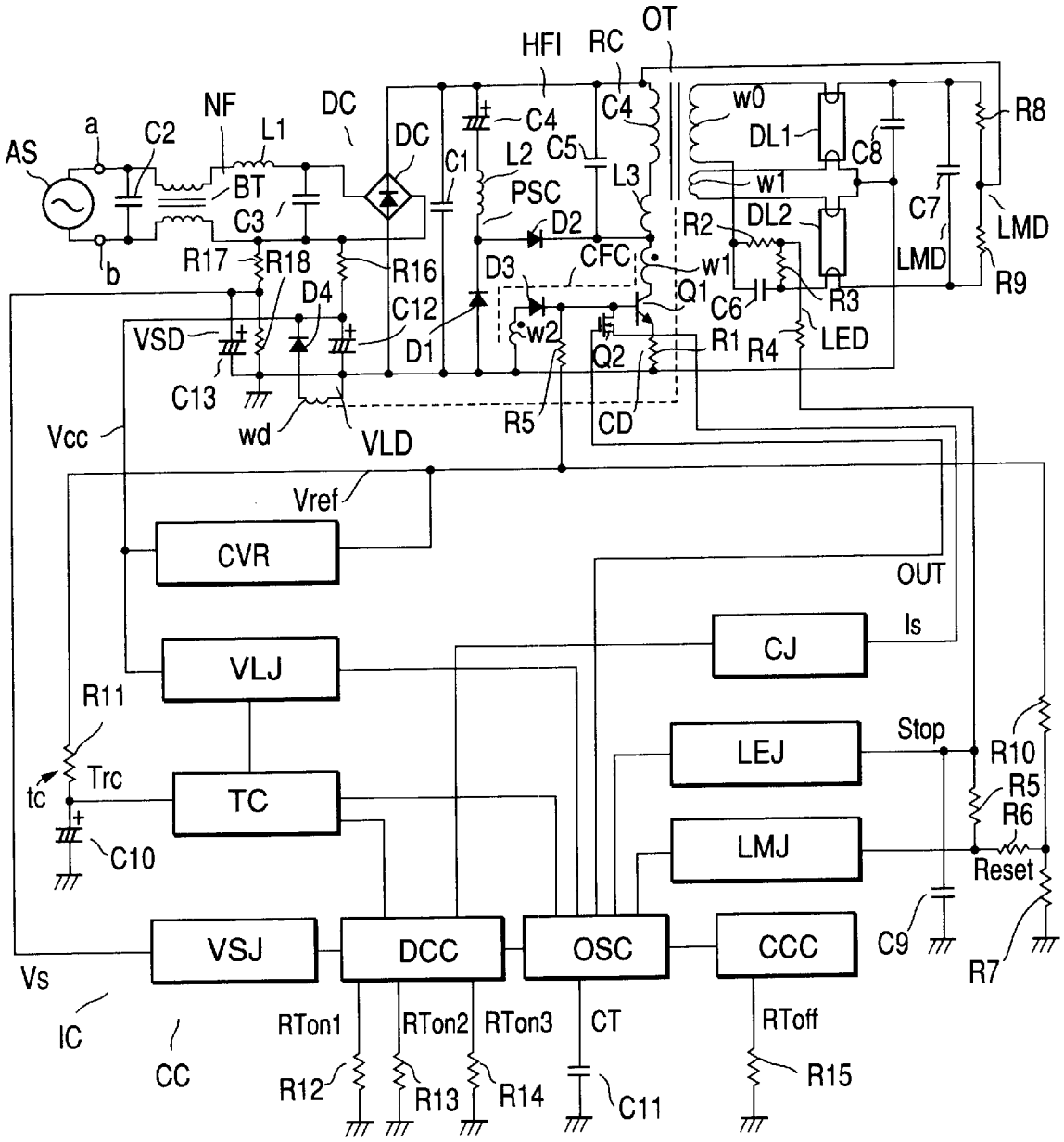
FIG. 1 is a circuit diagram showing the first embodiment of the discharge lamp lighting apparatus according to the present invention.

First, referring to FIGS. 1, 2, and 3*a* to 3*d* , the first embodiment of the discharge lamp lighting apparatus according to the present invention will be explained. FIG. 1 is a circuit diagram showing the first embodiment.

In FIG. 1, AS denotes a low-frequency AC power source, DC denotes a rectified DC power supply, HFI denotes a single-transistor voltage resonance inverter, and DL1, DL2 denote a discharge lamp. Further, a block LED denotes a lamp life terminal detecting circuit, a block LMD denotes a lamp installation detecting circuit, CC denotes a control circuit, a block CD denotes a current detector, a block VLD denotes a lamp voltage detecting circuit, and a block VSD denotes a power source voltage detecting circuit. Hereafter, those circuits will be explained in detail.

<Low-Frequency AC Power Source AS>

A low-frequency AC power source AS is a commercial 100 V power source.

<Rectified First DC Power Supply DC>

A rectified DC power supply DC is provided with input terminals a, b, a noise filter NF, a rectifier circuit FBR, a high frequency bypass capacitor C1, and a partial smoothing circuit PSC.

Input terminals a and b are coupled across the low-frequency AC power source AS.

The nose filter NF is provided with capacitors C2, C3, a balloon transformer BT, and an inductor L1. The nose filter NF prevents high frequency noise generated by the switching operation of the bipolar transistor Q1 in the signal-transistor voltage resonance inverter HFI to flow into the low-frequency AC power source AS. The capacitor C2 is coupled to between the input terminals a and b. A pair of windings of the balloon transformer BT is connected in both tracks pulled from the input terminals and b in the latter part of the capacitor C2. The inductor L1 is connected in the track at the side of the input terminal a in series in the latter part of the balloon transformer BT. The capacitor C3 is coupled to between both tracks in the latter part of the inductor L1.

The rectifier circuit FBR is provided with a bridge type full wave rectifier circuit.

The high frequency bypass capacitor C1 is coupled across the DC output terminal of the rectifier circuit FBR.

The partial smoothing circuit PSC is provided with a smoothing capacitor C4, an inductor L2, and diodes D1, D2. The smoothing capacitor C4, the inductor L2, and the diode D1 are coupled across the DC output of the rectifier circuit FBR in polarity shown in figures. The diode D2 is coupled between a connection node of the inductor and the diode D1 and a portion of the single-transistor voltage resonance inverter HFI in polarity shown in figures.

<Single-Transistor Voltage Resonance Inverter HFI>

A single-transistor voltage resonance inverter HFO is provided with a current transformer CT, a resonance circuit RC, a bipolar transistor Q1, a current feedback circuit CFC, an electric switch Q2, a current-limiting reactor L3, and an output transformer OT. One end of a primary winding w1 of a current transformer CT is coupled to an inductor L4 constituting a primary winding of the output transformer OT via an inductor L3, and the other end is coupled to a collector of the bipolar transistor Q1. Further, one end of a secondary winding w2 of the current transformer CT is coupled to a base of the bipolar transistor Q1 via a diode D3, and the other end is coupled to a ground circuit. The resonance circuit RC is provided with a parallel circuit of an inductor L4 and a capacitor C5. One end of the resonance circuit RC is coupled to an anode of the first DC power supply DC. Further, the other end of the resonance circuit RC is coupled to the collector of the bipolar transistor Q1 via the primary winding w1 of the current feedback circuit CFC in series, while it is coupled to a cathode of the diode D2 of the partial smoothing circuit PSC. An emitter of the bipolar transistor Q1 is coupled to a current detector CD, that is, a cathode of the rectifier first DC power supply DC via the current detecting resistor R1. The current feedback circuit DFD is provided with a primary winding w1, a secondary winding w2, and a diode D3. The secondary winding w2 and the diode D3 of the current feedback circuit CFC are coupled between the base and the emitter of the bipolar transistor Q1 via the current detecting resistor R1 in order. The base current cut-off device Q2 consists of MOSFET with small current capacity. A drain of the MOSFET is coupled to the base of the bipolar transistor Q1, while a source of it is coupled to the emitter of the bipolar transistor Q1. The current-limiting reactor L3 is a circuit component for limiting the lamp current of the discharge lamps DL1 and DL2 to predetermined amount. In the present embodiment, the inductor L3 is connected in the resonance circuit RC. The output transformer OT transforms the high frequency voltage to the voltage required for lighting the discharge lamp DL in the single-transistor voltage resonance inverter HFI. Here, the output transformer OT is constituted by coupling the output winding w0 magnetically to the inductor L4 of the resonance circuit RC. Furthermore, a filament heating winding wf and a detecting winding wd of a lamp voltage detecting circuit VLD are coupled to the output transformer OT magnetically.

<Discharge Lamps DL1, DL2 and Lighting Circuit Thereof>

Discharge lamps DL1 and DL2 are fluorescent lamps, and they are coupled to the output winding w0 of the output transformer OT via a DC cut-off capacitor C6 in series. The filament heating winding wf is coupled to each filament electrode at the center side of the discharge lamps DL1 and DL2 in series. The filament electrodes at the outside of the discharge lamps DL1 and DL2 comprises a filament preheating capacitor circuit FHC by coupled to the resonance capacitor C7 in series. Furthermore, a capacitor C8 coupled in parallel to the discharge lamp DL1 works for a sequence start operation.

<Lamp Life Terminal Detecting Circuit LED>

A lamp life terminal detecting circuit LED is provided with resistors 2 to 7, and a capacitor C9. The resistor R2 and R3 are coupled across the DC cut-off capacitor C6 in series. The resistors R4 to R7 are coupled in series between a connection node of the resistors R2 and R3 and a ground circuit. The capacitor C9 is coupled between a connection node of the resistors R4 and R5 and the ground circuit.

<Lamp Installation Detecting Circuit LMD>

The lamp installation detecting circuit LMD is provided with resistors R4 to R9. The resistors R4 to R7 share a circuit with the lamp life terminal detecting circuit LED. The resistors R8 and R9 are coupled in parallel to the discharge lamps DL1 and DL2 which are coupled in series. In addition, a connection node of the resistors R8 and R9 is coupled to an anode of the rectifier first DC power supply DC.

<Control Circuit CC>

A control circuit CC is provided with an integrated circuit IC and an external device. The integrated circuit IC contains an oscillator OSC, a charging current control circuit CCC, a discharge current control circuit DCC, a timer TC, a lamp life terminal determining circuit LEJ, a lamp installation determining circuit LMJ, a current determining circuit CJ, a lamp voltage determining circuit VLJ, a power source voltage determining circuit VSJ, and a constant voltage source CVR. Here, the circuit arrangements which has relatively few relations to the operation of the present invention is omitted to be shown in figures.

The integrated circuit IC is provided with terminals Reset, Stop, Is, OUT, Vref, Vcc, Trc, Vs, Rton1, Rton2, Rton3, CT, and Rtoff, etc. The output terminal of the lamp installation detecting circuit LMD is externally coupled to the terminal Reset, and the lamp installation determining circuit LMJ is internally coupled to the terminal Reset. The lamp life terminal detecting circuit LED is externally coupled to the terminal Stop, and the lamp life terminal determining circuit LEJ is internally coupled to the terminal Stop. A current detector DC is externally coupled to the terminal Is, and the current determining circuit CJ is internally coupled to the terminal Is. The gate of the electric switch Q2 is coupled to the terminal OUT, and the output terminal of the oscillator OSC is internally coupled to the terminal OUT. To the outside of the terminal Vref is coupled the current feedback circuit CFC, the time-constant circuit tc of the timer TC via the resistor Rs, and the connection node of the resistors R6 and R7 of the lamp installation detecting circuit LMD via the resistor R10, and the output terminal of the constant voltage source CVR is internally coupled to the terminal Vref in order to supply the constant voltage to each portion mentioned above. The lamp voltage detecting circuit VLD is externally coupled to the terminal Vcc, and the input terminal of the constant voltage source CVR and the lamp voltage determining circuit VLJ are coupled to the inside of the terminal Vcc. The time-constant circuit tc is externally coupled to the terminal Trc, and the timer TC is internally coupled to the terminal Trc. Here, the time-constant circuit tc is provided with a series circuit of a resistor R11 and a capacitor C10. The power source voltage detecting circuit VSD is externally coupled to the terminal Vs, and the power source voltage determining circuit VSJ is internally coupled to the terminal Vs. The capacitor discharging resistor R12 is externally coupled to the terminal Rton1, and the discharge current control circuit DCC is internally coupled to the terminal Rton1. The capacitor discharging resistor R13 is coupled to the terminal Rton2, and the discharge current control circuit DCC is internally coupled to the terminal Rton2. The capacitor discharging resistor R14 is externally coupled to the terminal Rton3, and the discharge current control circuit DCC is internally coupled to the terminal Rton3. The timing capacitor C11 is externally coupled to the terminal CT, and the oscillator OSC is internally coupled to the terminal CT. The capacitor charging resistor R15 is externally coupled to the terminal Rtoff, and the charging current control circuit CCC is internally coupled to the terminal Rtoff. Here, the a ground circuit inside of the integrated circuit IC is externally coupled to the integrated circuit IC as needed.

Figure 2:
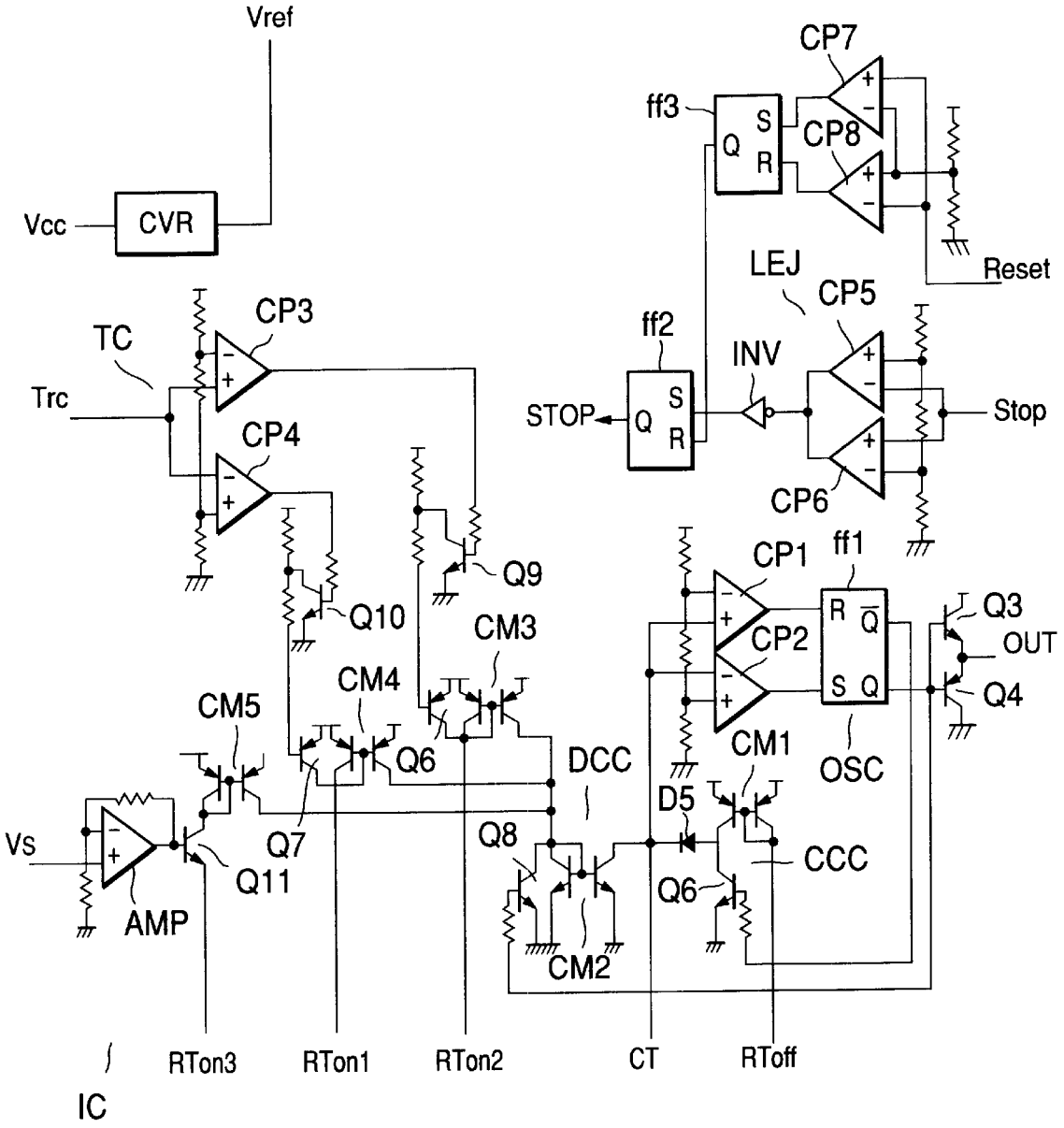
FIG. 2 is a circuit diagram showing the principal part of the integrated circuit in the first embodiment of the discharge lamp lighting apparatus according to the present invention.

Further, the principal part of the integrated circuit IC is comprised as shown in FIG. 2.

FIG. 2 is a circuit diagram showing the principal part of the integrated circuit of the first embodiment of the discharge lamp lighting apparatus according to the present invention. In FIG. 2, the same elements as those, as shown in FIG. 1, are assigned with the same marks.

<Oscillator OSC>

The oscillator OSC is provided with a flip-flop ff, a pair of comparators CP1 and CP2, base current cut-off devices Q3 and Q4, an external timing capacitor C11, a capacitor charging resistor R15, and capacitor discharging resistors R12 to R14. While the timing capacitor C11 is charged via the capacitor charging resistor R15, the off-switching signal output from the terminal OUT gets to high state. When the voltage across the terminals of the timing capacitor C11 exceeds the reference voltage of the comparator CP1 with the passage of time, the output of the comparator CP1 gets to high, and the flip-flop ff is reversed. In addition, the terminal Q gets to low, the base current cut-off device Q3 is turned off, and the base current cut-off device Q4 is turned on. Consequently, the off-switching signal output from the terminal OUT gets to low state. At that time, the electrical charge of the timing capacitor C11 is discharged through any of the resistors R12 to R14 selected according to the operation mode. Therefore, the voltage across the terminals of the timing capacitor C11 is lowered gradually. When the voltage across the terminals of the timing capacitor C11 lowers the reference level, the oscillator is reset to the first state again. Hereafter, since the circuit operations mentioned above are repeated, the off-switching signal is generated and sent out from the terminal OUT.

<Charge Current Control Circuit CCC>

The charging current control circuit CCC is principally provided with an external capacitor charging resistor R15, a current mirror circuit CM1, a base current cut-off device Q5, and a diode D5. At the time of charging the timing capacitor C11, a current which is equal to a current flowing to the capacitor charging resistor R15 flows to the timing capacitor C11 via the diode D5 as a charging current since the current mirror circuit CM1 is turned on. Therefore, since the charging of the timing capacitor C11 is performed at a constant pace at all times, the on-duration of the off-switching signal becomes constant.

<Discharging Current Control Circuit DCC>

The discharge current control circuit DCC is principally provided with external capacitor discharging resistors R12 to R14, current mirror circuits CM2 to CM5, and base current cut-off devices Q6 to Q8. At the time of preheating mode, a discharge current flows to all capacitor discharging resistors R12 to R14 via the current mirror circuits CM2 to CM5. All these discharge currents are discharged from the timing capacitor C11. Therefore, the discharging time in the preheating mode is short. Since the base current cut-off device Q7 is turned on in the starting mode, the current mirror circuit CM4 is turned off. Therefore, the discharging time in the starting mode becomes relatively long. Since the base current cut-off device Q6 is turned off in the lighting mode, the discharging time becomes the longest.

<Timer TC>

The timer TC is principally provided with a time-constant circuit tc (which is external), a pair of comparators CP3 and CP4, and base current cut-off devices Q9 and Q10. A pair of comparators CP3 and CP4 compares the output of the time-constant circuit tc and the reference voltage. In addition, the comparator CP4 turns the base current cut-off device Q10 on when its output gets to the high level, so that it decides the starting time of the starting mode. Further, when the output of the time-constant circuit tc is increased to exceed the reference voltage of the comparator CP3, the base current cut-off device Q9 is turned on, so that the starting mode is completed and shifted to the lighting mode. When the discharge lamps DL1 and DL2 are not lighted during the starting mode, the operation of the oscillator OSC is stopped by the protection circuit (not shown in FIG. 2.)

<Lamp Life Terminal Determining Circuit LEJ>

The lamp life terminal determining circuit LEJ is principally provided with comparators CP5 and CP6, an inverter INV, and a flip-flop ff2. When the potential of the terminal Stop exceeds a maximum value, the comparator CP5 becomes a low level. Further, when the potential of the terminal Stop lowers the minimum value, the comparator CP6 becomes a low level. In any case, as the potential changes to the high-level by the inverter INV and input to the flip-flop ff, a shut-down signal is generated. Here, the shut-down signal is input to the oscillator OSC in order to shut-down the oscillation of the oscillator OSC.

<Lamp Installation Determining Circuit LMJ>

The lamp installation determining circuit LMJ is principally provided with comparators CP7 and CP8 and flip-flops ff3 and ff2. By the potential of the terminal Rset according to the non-installation/installation of the discharge lamps DL1 and DL2 at power-on, the flip-flop ff3 is operated, further, the flip-flop ff2 is operated together to generate a shut-down signal or reset to release the shut-down signal.

<Power Source Determining Circuit VSJ>

The power source determining circuit VSJ is principally provided with an amplifier AMP whose input terminal is coupled to the terminal INP, and a bipolar transistor Q11. The amplifier AMP amplifies a voltage which increases in proportion to a low-frequency AC power source voltage appearing in the terminal INP, so as to change the conductivity of the bipolar transistor Q11. As the result, the discharge current of the timing capacitor C11 of the oscillator OSC is adjusted according to the fluctuation of the power source voltage. Therefore, the off-duration of the off-switching signal is adjusted, and the fluctuation of the low-frequency AC voltage is compensated.

<Current Detector CD>

The current detector CD is provided with a current detecting resistor R1. The current detecting resistor R1 is connected to an emitter circuit of the bipolar transistor Q1 as mentioned above, and its detecting output terminal is coupled to the terminal Is of the integrated circuit IC.

<Ramp Voltage Detecting Circuit VLD>

The ramp voltage detecting circuit VLD is provided with a lamp voltage detecting winding wd, a diode D4, and a smoothing capacitor C12. The lamp voltage detecting winding wd is magnetically coupled to the output transformer OT of the single-transistor voltage resonance inverter HFI, and one end of the lamp voltage detecting winding wd is coupled to a cathode of the rectifier first DC power supply DC. The diode D4 rectifies a voltage corresponding to the lamp voltage induced in the lamp voltage detecting winding wd, while the anode of the diode D4 is coupled to the other end of the lamp voltage detecting winding wd. The smoothing capacitor C12 is coupled between the cathode of the diode D4 and one end of the lamp voltage detecting winding wd, in order to smooth the rectified voltage. The connecting node of the diode D4 and the smoothing capacitor C12 is coupled to the terminal Vcc of the integrated circuit IC.

<Power Source Voltage Detecting Circuit VSD>

The power source voltage detecting circuit VSD is provided with resistors R17 and R18 and a smoothing capacitor C13. The resistors R17 and R18 is connected in series between one end of the AC input terminals of the rectifier circuit FBR and a ground circuit. The capacitor C13 is connected in parallel to the resistor R18. The connecting node of the resistors R17 and R18 is coupled to the terminal INP of the integrated circuit IC.

<Preheating Operation>

When the low-frequency AC power source AS is turned on, the low-frequency AC voltage is rectified in the rectifier first DC power supply DC, in addition, it is smoothed so as to applied across the input terminal of the single-transistor voltage resonance inverter HFI. At the same time, the voltage is applied to the smoothing capacitor C12 via the resistor R16 of the lamp voltage detecting circuit VLD so as to be smoothed, then, it is applied to the input terminal of the constant voltage source CVR via the terminal Vcc of the integrated circuit IC in the control circuit CC. The voltage fixed in the constant voltage source CVR, that is the constant voltage is output to the terminal Vref. The time-constant circuit tc is operated and each part in the control circuit CC is operated by using the constant voltage as the operating power. The operation immediately after power-on operation is preheating operation. At that time, all capacitor discharging resistors R1 to R14 start discharging to the timing capacitor C11 of the oscillator OSC. Therefore, the discharging time of the timing capacitor C11 becomes the shortest. Consequently, the off-duration of the off-switching signal generated from the oscillator OSC becomes the shortest.

Immediately after powering on, the single-transistor voltage resonance inverter HFI is operated in the preheating mode. In the preheating mode, since the off-duration of the off-switching signal from the oscillator OSC is the shortest, the operation frequency of the single-transistor voltage resonance inverter HFI becomes the highest. The operation frequency is relatively apart from the resonance point frequency of the resonance characteristic curve in the resonance circuit RC. Therefore, The output voltage of the single-transistor voltage resonance inverter HFI is relatively low, so that the heating of the filament of the discharge lamps DL1 and DL2, that is the preheating is performed.

<Starting Operation>

After turning the power on, the predetermined time passes, and the output of the time-constant circuit tc exceeds the reference potential of the comparator CP4, thus, the output of the comparator CP4 of the timer TC gets to high and shifted to the starting mode. At that time, the base current cut-off device Q10 is tuned on. Accordingly, the base current cut-off device Q7 of the discharge current control circuit DCC is turned on, and the current mirror circuit CM4 is turned off. According to the operation of the discharge current control circuit DCC mentioned above, the resistor R12 is isolated from the discharge path. As the result, the off-duration of the off-switching signal generated from the oscillator OSC becomes longer than that in the preheating mode.

Accordingly, since the single-transistor voltage resonance inverter HFI is operated by the off-switching signal whose off-duration becomes longer than that in the preheating mode, its operation frequency lowers that in the preheating mode. The operation frequency of the single-transistor voltage resonance inverter HFI is relatively close to the resonance point frequency of the resonance characteristic curve of the resonance circuit RC. Therefore, the output voltage of the single-transistor voltage resonance inverter HFI become relatively high, and the starting operation of the discharge lamps DL1 and DL2 are promoted. Here, the discharge lamps DL1 and DL2 are started in a sequence method.

When the time passes further, and the output of the time-constant circuit tc increases further to exceed the reference potential of the comparator CP3, the output of the comparator CP3 becomes high, and the base current cut-off device Q9 is turned on. Accordingly, the base current cut-off device Q6 of the discharge current control circuit DCC is turned on, and the current mirror circuit CM3 is turned off. According to the operation of the discharge current control circuit DCC mentioned above, the capacitor discharging resistor R13 is isolated from the discharge path also and shifted to the lighting mode.

<Lighting Operation>

In the lighting mode, only the capacitor discharging resistor R14 is coupled to the discharge path of the timing capacitor C11 of the oscillator OSC. Therefore, the discharging time becomes longer than that at the starting mode. As the result, the off-duration of the off-switching signal generated form the oscillator OSC becomes still longer. The single-transistor voltage resonance inverter HFI is operated by the off-switching signal whose off-duration becomes longer than that in the preheating mode. Consequently, it operation frequency lowers that at the time of the starting operation. The operation frequency of the single-transistor voltage resonance inverter HFI is further close to the resonance point frequency of the resonance characteristic curve of the resonance circuit RC, and the output voltage of the single-transistor voltage resonance inverter HFI becomes still higher than that at the time of starting mode. However, if the discharge lamps DL 1 and DL2 are lighted, the voltage across the electrodes is lowered to the lamp voltage.

The operation of each part of the discharge lamp lighting apparatus at the time of the operation mode will be understood further in FIGS. 3*a* to 3*d*.

Figure 3A:
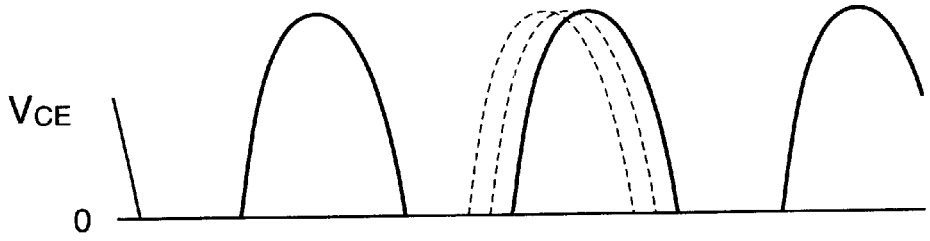
FIGS. 3*a* to 3*d* are diagrams showing the waveforms of voltage and current of each part of the first embodiment of the discharge lamp lighting apparatus according to the present invention.
Figure 3B:
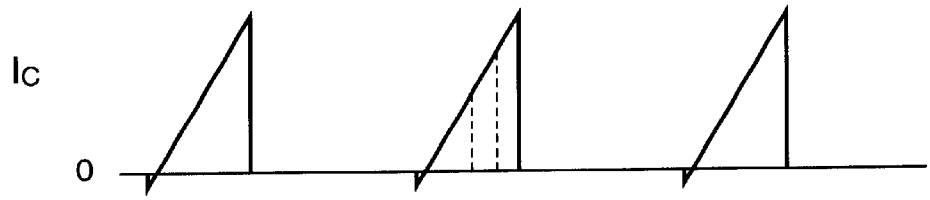
Figure 3C:
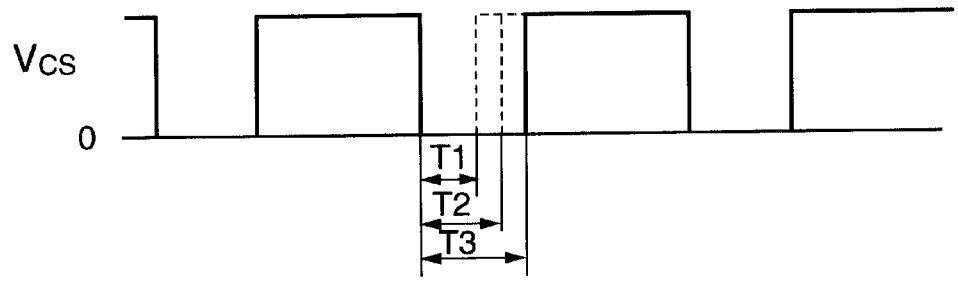
Figure 3D:
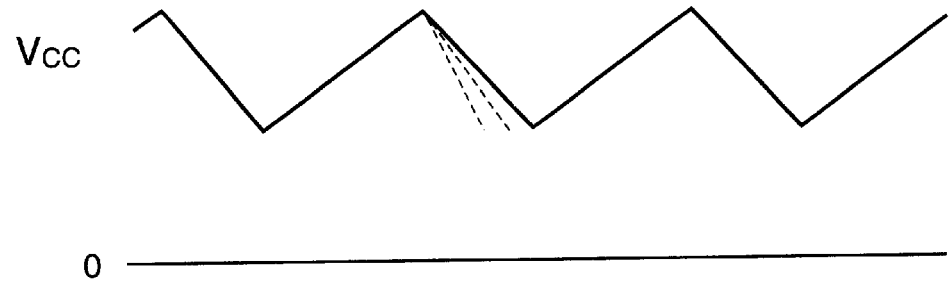

FIGS. 3*a* to 3*d* is a waveform diagrams showing waveforms of the voltage and current in each part of the discharge lamp lighting apparatus of the first embodiment according to the present invention. FIG. 3*a* is showing a waveform of the voltage VCE across and through the collector-emitter of the bipolar transistor Q1. FIG. 3*b* is showing a waveform of the collector current IC of the bipolar transistor Q1. FIG. 3*c* is showing a waveform of the off-switching signal voltage VCS from the oscillator OSC. Here, T1, T2, and T3 shown on the time axis in the FIG. 3*b* denote a time width at the time of preheating mode, a time width of the time of the starting mode, and a time width at the time of lighting mode. FIG. 3*d* is showing a waveform of the voltage VC11 across the terminals of the timing capacitor C11.

<Lamp Life Terminal Detecting and Determining Operation>

The lamp life terminal detecting and determining operation will be explained. When either one of the discharge lamps DL1 and DL2 is in the life terminal, the lamp will be in the half-wave discharge state, and a DC component is superimposed on the lamp current. The DC component is detected in the lamp life terminal detecting circuit LED. The detecting output is input to the lamp life terminal determining circuit LEJ via the terminal Stop of the integrated circuit IC. When the lamp life terminal determining circuit LEJ determines the lamp life terminal state of the discharge lamp, it generates the shut-down signal in order to shut-down the single-transistor voltage resonance inverter HFI compulsorily, so as to perform the protective action.

<Lamp Non-Installation Detecting and Determining Operation>

The lamp non-installation detecting and determining operation will be explained. When either one or both of the discharge lamps DL1 and DL2 are not installed on (including insufficient installation such as an one end open installation), the lamp current flowing to the load circuit becomes almost zero. The lamp installation detecting circuit LMD detects that the lamp current flowing to the load circuit is below a predetermined value, thus it detects the lamp non-installation. The detecting output is input to the lamp installation determining circuit LMJ via the terminal Rset of the integrated circuit IC. When the lamp installation determining circuit LMJ determines the lamp non-installation, it generates a shut-down signal to shut-down the operation of the single-transistor voltage resonance inverter HFI compulsorily, thus it performs a protective action. Here, when the discharge lamp is installed on appropriately, the shut-down signal is released.

<Circuit Current Stabilizing Operation>

The circuit current is detected in the current detector CD, then it is inputted to the current determining circuit CJ via a terminal Is of the integrated circuit IC. The determined result from the current determining circuit CJ is input to the oscillator OSC. As the result, when the circuit current fluctuates, the cycle of the oscillator OSC is varied so as to compensate the fluctuation according to the changing of the circuit current. Consequently, the circuit current is stabilized.

<Power Source Voltage Compensation Operation>

The low-frequency AC power source voltage is detected in the power source voltage detecting circuit VSD, then it is input to the power source voltage determining circuit VSJ via a terminal INP of the integrated circuit IC. The determined result from the power source voltage determining circuit VSJ is input to the oscillator OSC. As the result, when the low-frequency AC power source voltage fluctuates, the cycle of the oscillator OSC is varied so as to compensate the fluctuation in response to the fluctuation. Therefore, according to the operation mentioned above, the fluctuation of the low-frequency AC power source voltage is compensated.

<Lamp Lighting Failure Detecting and Determining Operation>

When either one or both of the discharge lamps DL1 and DL2 is in the non-lighting state, the lamp voltage lowers a predetermined value. The lamp voltage is inputted to a lamp lighting failure detecting and determining circuit LNO which is integrated in the integrated circuit IC of the control circuit CC via a terminal Vcc. The lamp lighting failure detecting and determining circuit LNO is coupled to the timer TC, so that its operation is controlled. As the result, since the lamp voltage lowers the predetermined voltage when at least one of the lamps is non-lighted, the non-lighted state is determined in the lamp lighting failure detecting and determining circuit LNO, thus the timer TC is controlled as needed. The lamp voltage is inputted to a lamp lighting failure determining circuit VLJ which is integrated in the integrated circuit IC of the control circuit CC via a terminal Vcc. The lamp lighting failure determining circuit VLJ is coupled to the timer TC, so that its operation is controlled. As the result, since the lamp voltage lowers the predetermined voltage when at least one of the lamps is non-lighted, the non-lighted state is determined in the lamp lighting failure determining circuit VLJ, thus the timer TC is controlled as needed.

Figure 4:
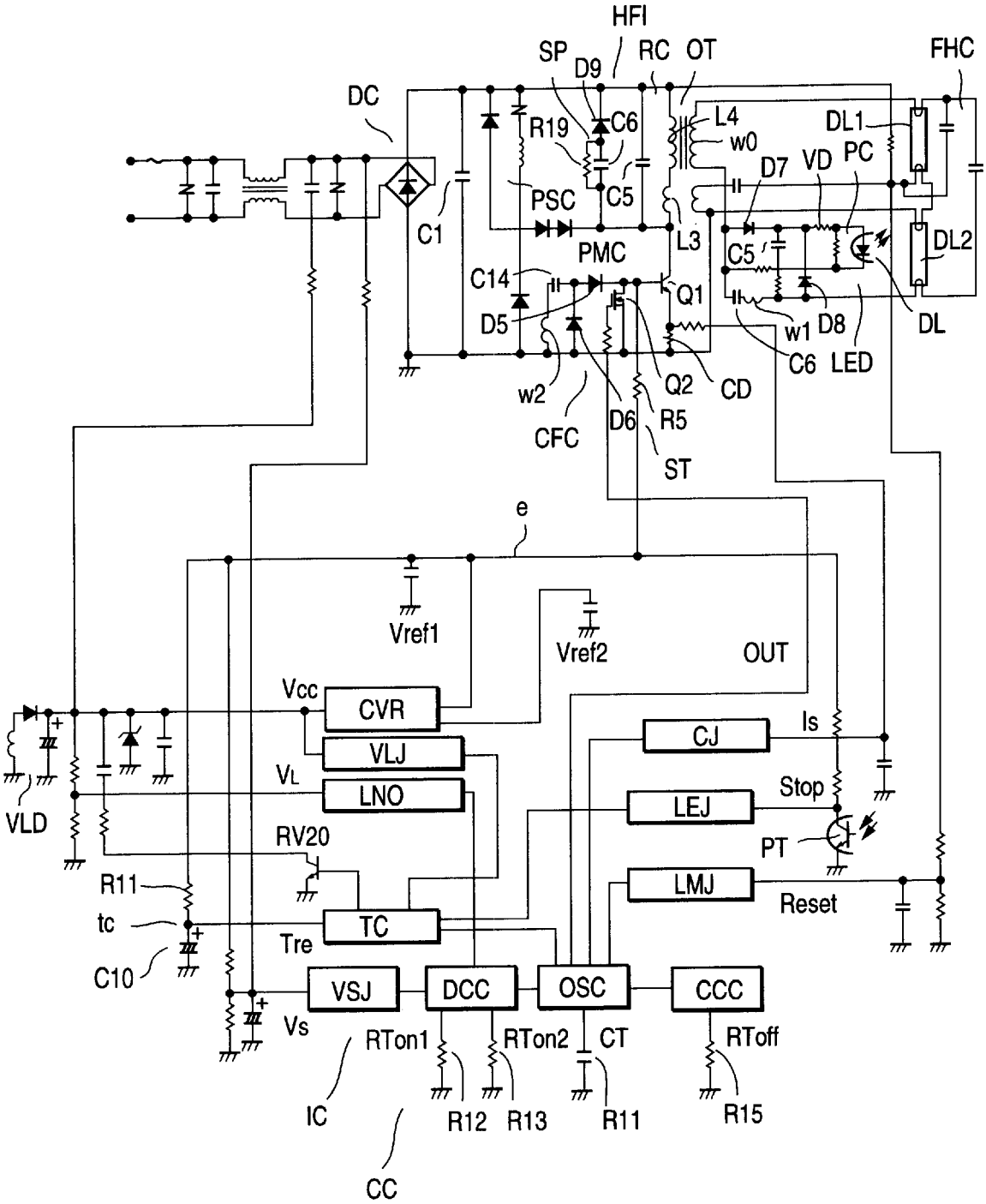
FIG. 4 is a circuit diagram showing the second embodiment of the discharge lamp lighting apparatus according to the present invention.
Figure 5:
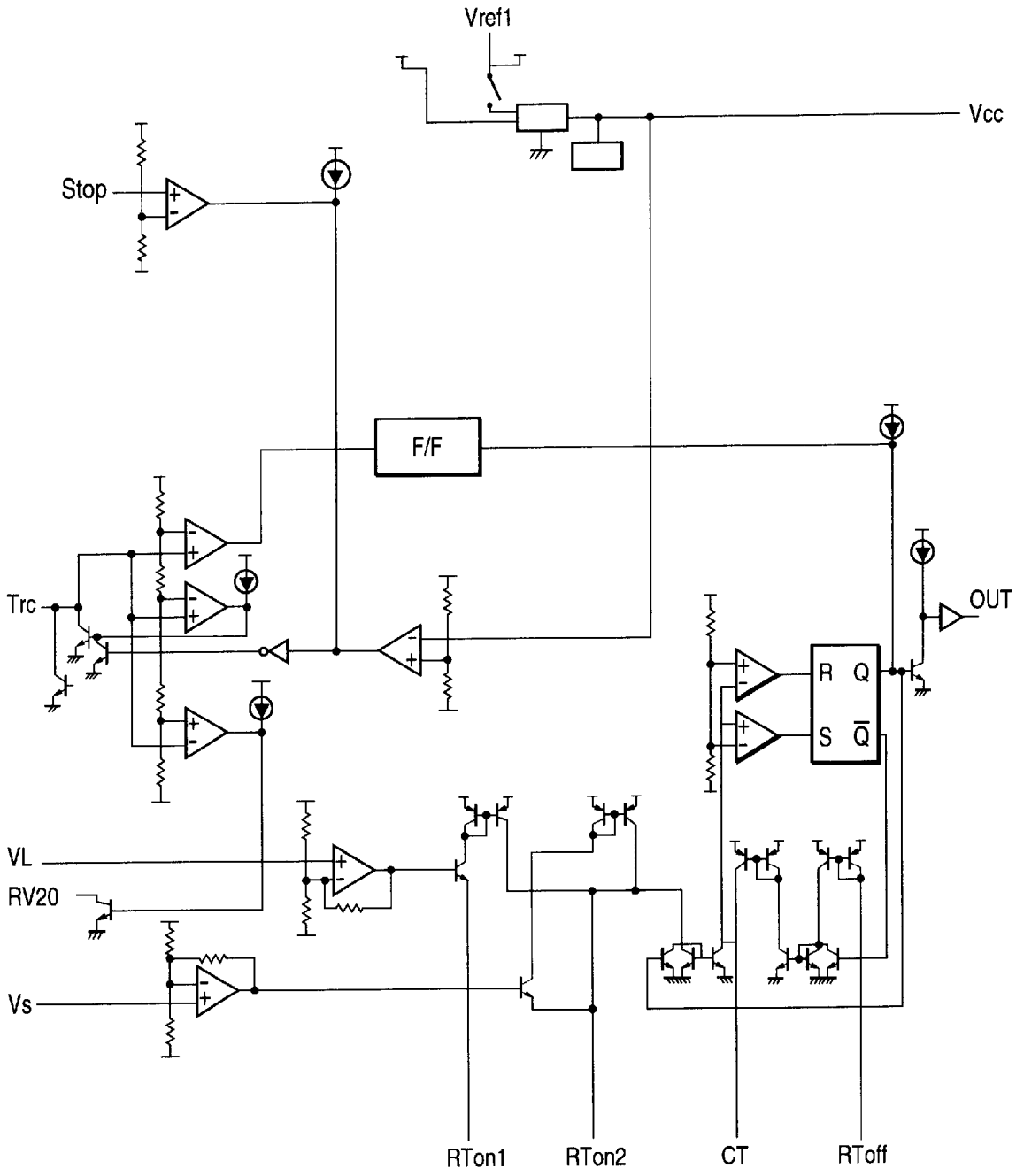
FIG. 5 is a circuit diagram showing a internal circuitry of the principal part of the integrated circuit CC shown in FIG. 4.

Next, referring to FIGS. 4 to 6, second embodiment of the discharge lamp lighting apparatus according to the present invention will be explained. FIG. 4 is a circuit diagram showing the second embodiment. FIG. 5 is a circuit diagram showing the internal circuitry of the principal part of the integrated circuit CC. FIGS. 6*a* to 6*h* is waveform diagrams showing the waveforms of the voltage and the current of each portion in the second embodiment. FIG. 7 is a circuit diagram for explaining principally a passage of the reverse current flowing the collector from the base of the bipolar transistor Q1 in the single-transistor voltage resonance inverter HFI as shown in FIG. 4. The second embodiment has a different configuration of the current feedback circuit CFC, the lamp life terminal detecting circuit LED, and the lamp lighting failure detecting circuit LNO principally from the first embodiment, further it includes a serge-protection circuit SP. Therefore, those circuits are explained hereinafter, and the same elements as those shown in FIGS. 1 and 2 are assigned with the same marks.

First, referring to FIG. 7, the turn-on operation of the bipolar transistor Q1 in the single-transistor voltage resonance inverter of the second embodiment will be explained. In addition, in the second embodiment, the turn-on operation of the bipolar transistor Q1 is performed without depending on the current transformer CT. That is, according to the resonance operation of the inductance of the inductor L3 in the resonance circuit RC, the inductance of the primary winding L4 in the output transformer OT, and the high frequency bypass capacitor C1, the current flows to the collector from the base of the bipolar transistor Q1 (shown by an arrow in FIG. 7). As the result, a minority carrier is accumulated at the base region. Then, when the polarity of the resonance current is reversed, and the positive voltage is applied to the collector, the current flows to the base from the collector to emit the minority carrier accumulated at the base region. At that time, a part of the current flows also to an emitter.

The current feedback circuit CFC is provided with a current transformer CT, a phase matching circuit PMC, and a diode D3. The primary winding w1 of the current transformer CT is connected to a series circuit of the output winding w0 of the primary winding w1, the discharge lamps DL1 and DL2, and the DC cut-off capacitor C6, that is to the current path of the discharge lamps DL1 and DL2. Further, one end of the secondary winding w2 of the current transformer CT is coupled to the base of the bipolar transistor Q1 via the phase matching circuit PMC and the diode D3, and the other end of it is coupled to the ground circuit. The phase matching circuit PMC is provided with a series circuit of the capacitor C14 and the diode D6 coupled in parallel to the secondary winding w2 of the current transformer CT. Here, the cathode of the diode D6 is coupled to the capacitor C14, and the anode of the diode D6 is coupled to the ground circuit.

A current feedback circuit CFC feeds back the current induced in the secondary winding w2 of the current transformer CT to the base of the bipolar transistor Q1. Moreover, the phase matching circuit PMC matches the phase of its feedback current to the phase of the resonance circuit RC. In addition, the feedback current is implied to the base circuit of the bipolar transistor Q1 of the diode D3. As the result, according to the feedback operation of the lamp current to the base of the bipolar transistor Q1 at the constant operation-duration, the bipolar transistor Q1 is turned on.

The turn off operation of the bipolar transistor Q1 is performed by the on operation of the base current cut-off device Q2 coupled in parallel to the base and emitter circuit. That is, since the base current cut-off device Q2 is turned on by the off-switching signal from the control circuit CC, the base current is short-circuited, then the bipolar transistor Q1 is turned off. The base current cut-off device Q2 is provided with the MOSFET.

The lamp life terminal detecting circuit LED includes a photo-coupler PC in its output stage. When the discharge lamp is in the lamp life terminal, and the lamp is lighted in the half-wave discharge state, the DC component which is superimposed on the lamp current and detected in the lamp life terminal detecting circuit LED is sent to the control circuit CC via the photo coupler PC. That is, the voltage appears across the DC cut capacitor C6 is rectified by a full-wave rectifier circuit provided with diodes D7 and D8 and smoothed in a smoothing capacitor C15, further, it is divided in a voltage divider VD, so that the divided DC voltage is applied to a light emitting diode LD of the photo coupler PC. The light emitting diode LD is connected to the lamp current circuit side, and the photo bipolar transistor PT is coupled between the terminal Stop of the lamp life terminal determining circuit LEJ of the control circuit CC and the grounding point.

Next, the lamp voltage constant operation in the second embodiment will be explained. The lamp voltage is detected in the lamp voltage detecting circuit VLD, and its resistance is divided, then it is input to the lamp voltage determining circuit LNO VLD. When the fluctuation of the lamp voltage is determined, the cycle of the oscillator OSC is varied to compensate the fluctuation, in response to the determination of the fluctuation. Therefore, the lamp voltage is stabilized.

The serge-protection SP is provided with a series circuit of a diode D9 and a capacitor C16 and a capacitor discharging resistor R19 which is coupled in parallel to the capacitor C16, and then coupled to in parallel to a resonance circuit RC.

Figure 6A:
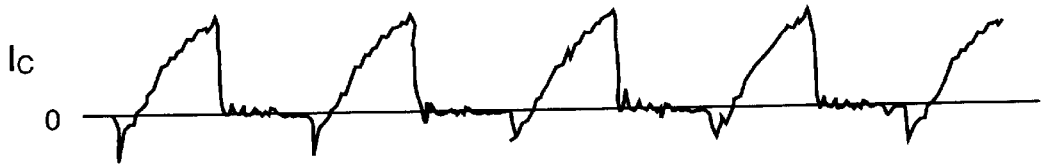
FIGS. 6*a* to 6*h* are diagrams showing the waveforms of voltage and current of each part of the second embodiment of the discharge lamp lighting apparatus according to the present invention.
Figure 6B:
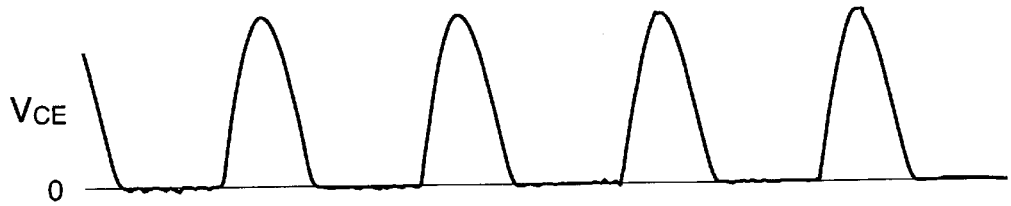
Figure 6C:
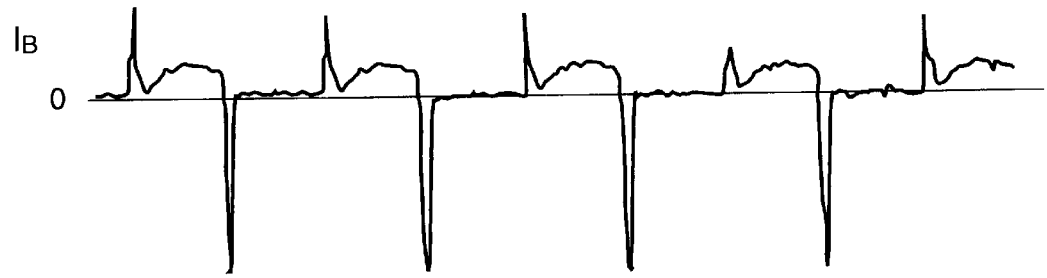
Figure 6D:
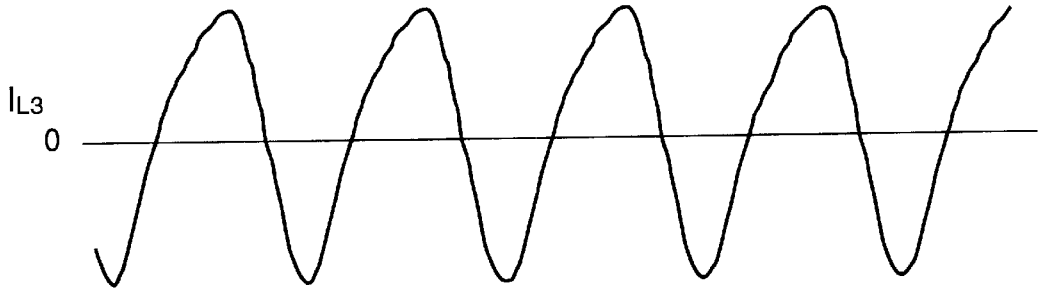
Figure 6E:
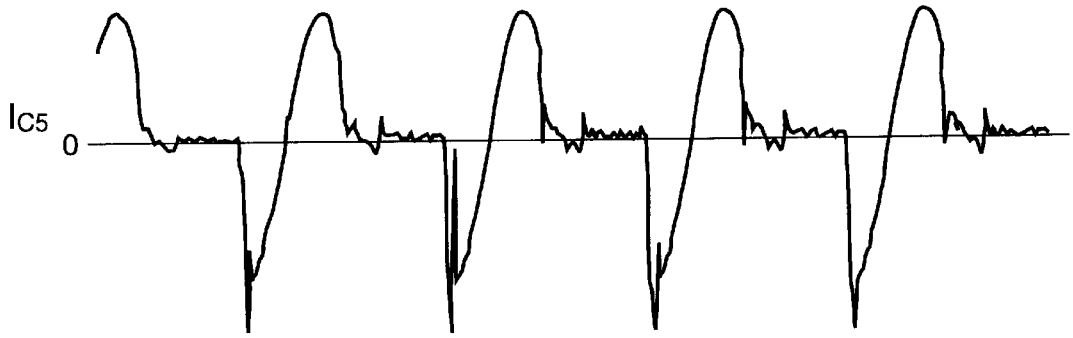
Figure 6F:
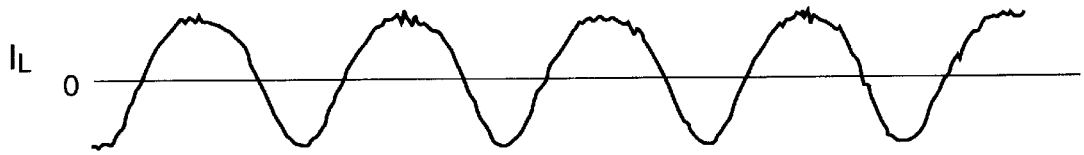
Figure 6G:
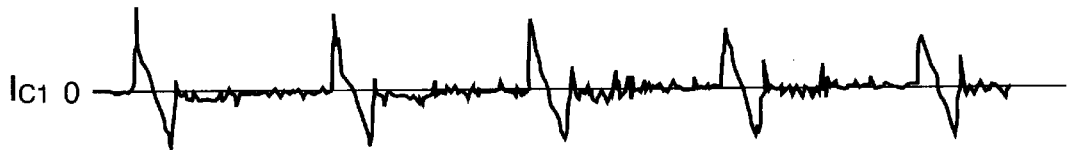
Figure 6H:
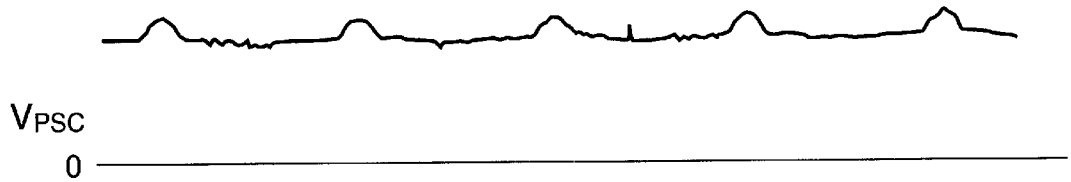
Figure 7:
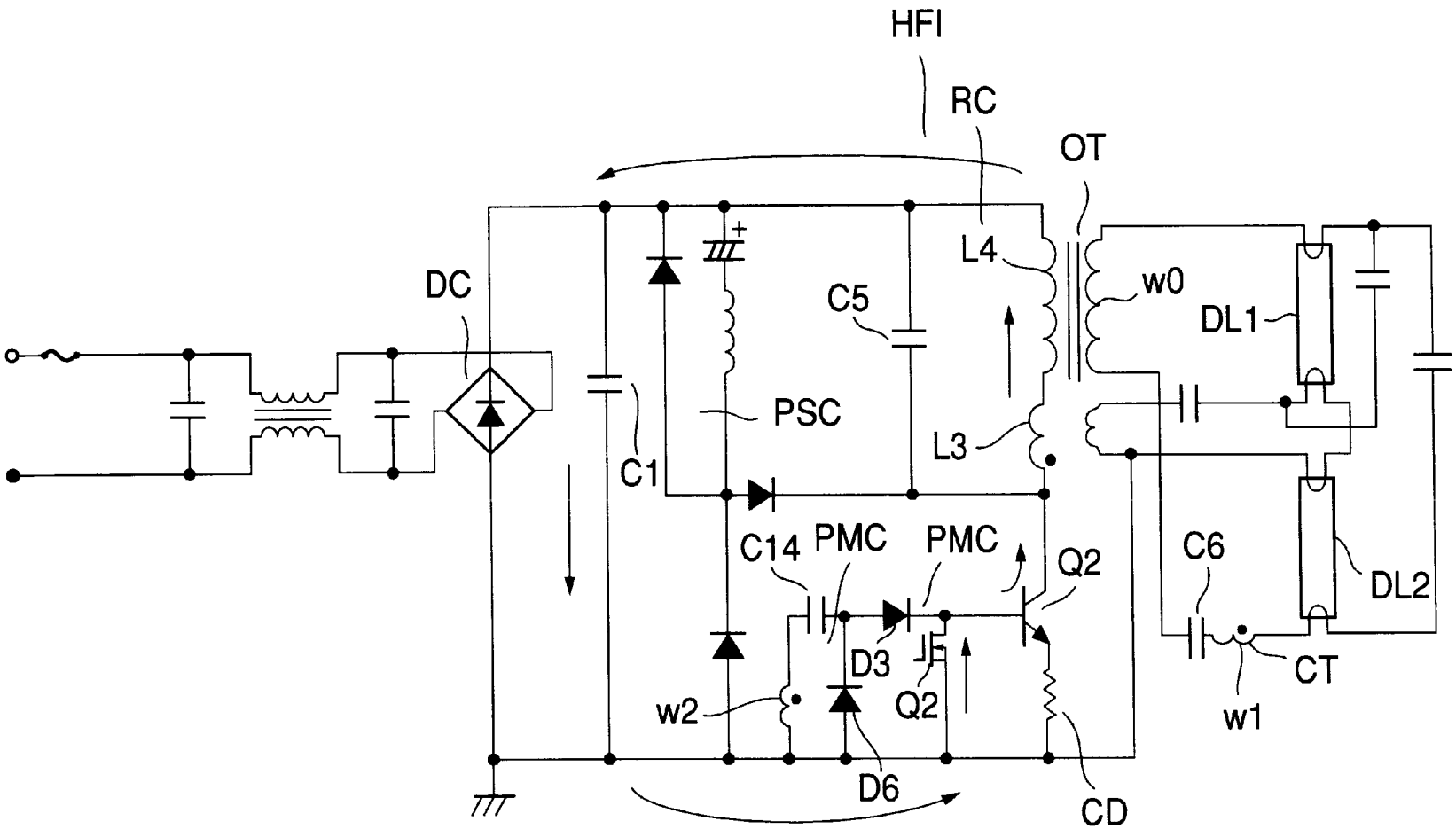
FIG. 7 is a circuit diagram showing the single-transistor voltage resonance inverter principally in the third embodiment of the discharge lamp lighting apparatus according to the present invention.

FIGS. 6*a* to 6*h* are waveform diagrams showing the waveforms of the voltage and the current of each part of the second embodiment. FIG. 6*a* is showing a waveform of the collector current IC of the bipolar transistor Q1. FIG. 6*b* is showing a waveform of the voltage across and through the collector-emitter VCE. FIG. 6*c* is showing a waveform of the base current IB. FIG. 6*d* is showing a waveform of a current IL3 flowing to the inductor L3 of the resonance circuit RC. FIG. 6*e* is showing a waveform of a current IC5 flowing to the capacitor C5. FIG. 6*f* is showing a waveform of a load current IL. FIG. 6*g* is showing a waveform of a current IC1 flowing to the high-frequency bypass capacitor C1. FIG. 6*h* is showing a waveform of a partial smoothing voltage VPSC.

Figure 8:
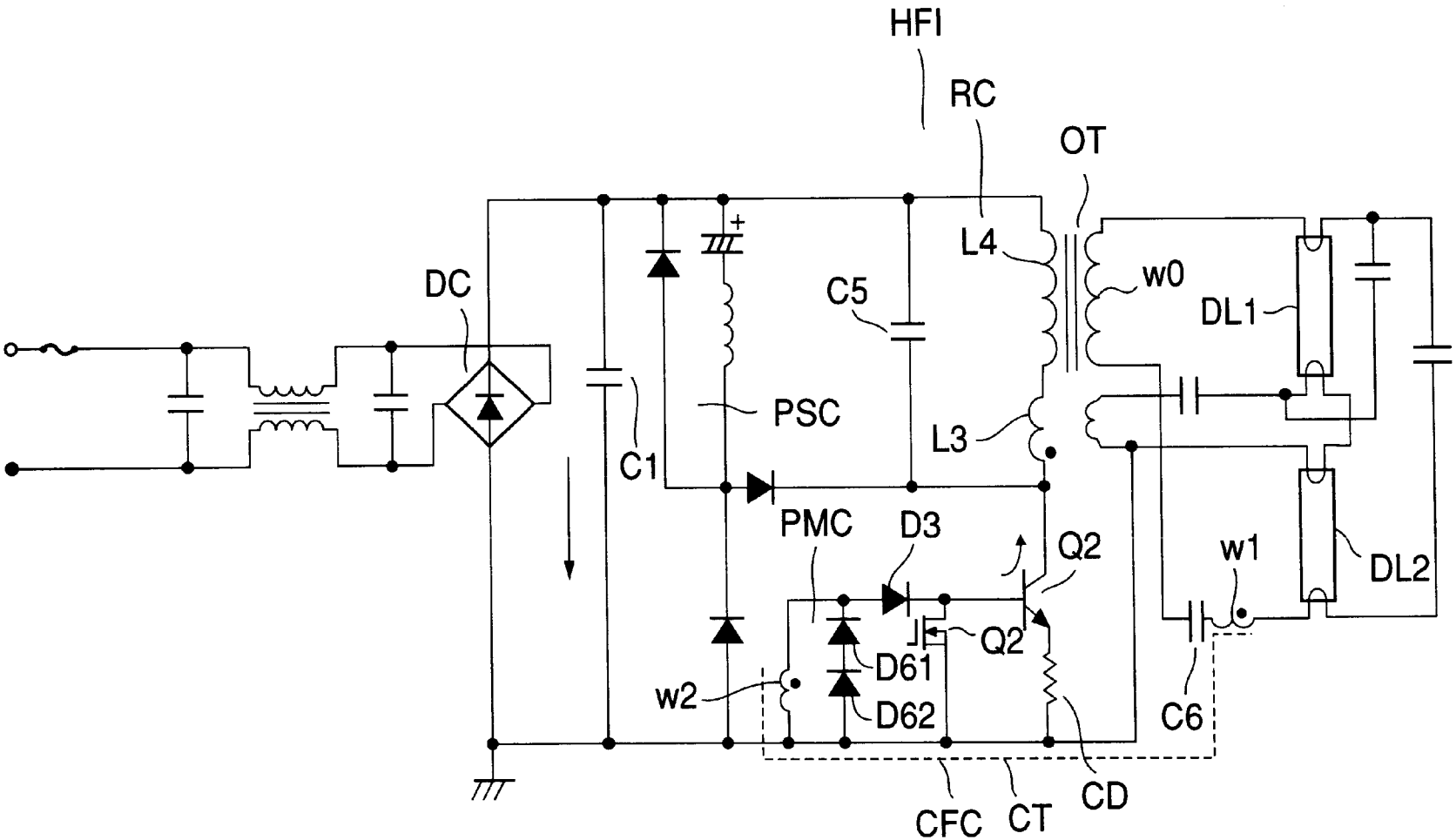
FIG. 8 is a circuit diagram showing the single-transistor voltage resonance inverter principally in the fourth embodiment of the discharge lamp lighting apparatus according to the present invention.

Next, referring to FIG. 8, the third embodiment of the discharge lamp lighting apparatus according to the present invention will be explained. FIG. 8 is a circuit diagram showing principally the single-transistor voltage resonance inverter of the third embodiment of the present invention according to the present invention. In FIG. 8, the same elements, as those shown in FIG. 4, are assigned with the same marks and omitted the explanation. The present embodiment has a configuration of the current feedback circuit CFC different from the second embodiment as shown in FIG. 4.

That is, in the current feedback circuit CFC, a phase matching circuit PMC has a series circuit of plurality of, for instance, two diodes D61 and D62. The series diode circuit is coupled to in parallel to the secondary winding w2 of the current transformer CT. Here, the phase matching circuit PMC of the third embodiment does not need the capacitor C14 coupled in series to the secondary winding w2 of the current transformer CT, which are mentioned in the second embodiment as shown in FIG. 4.

Figure 9:
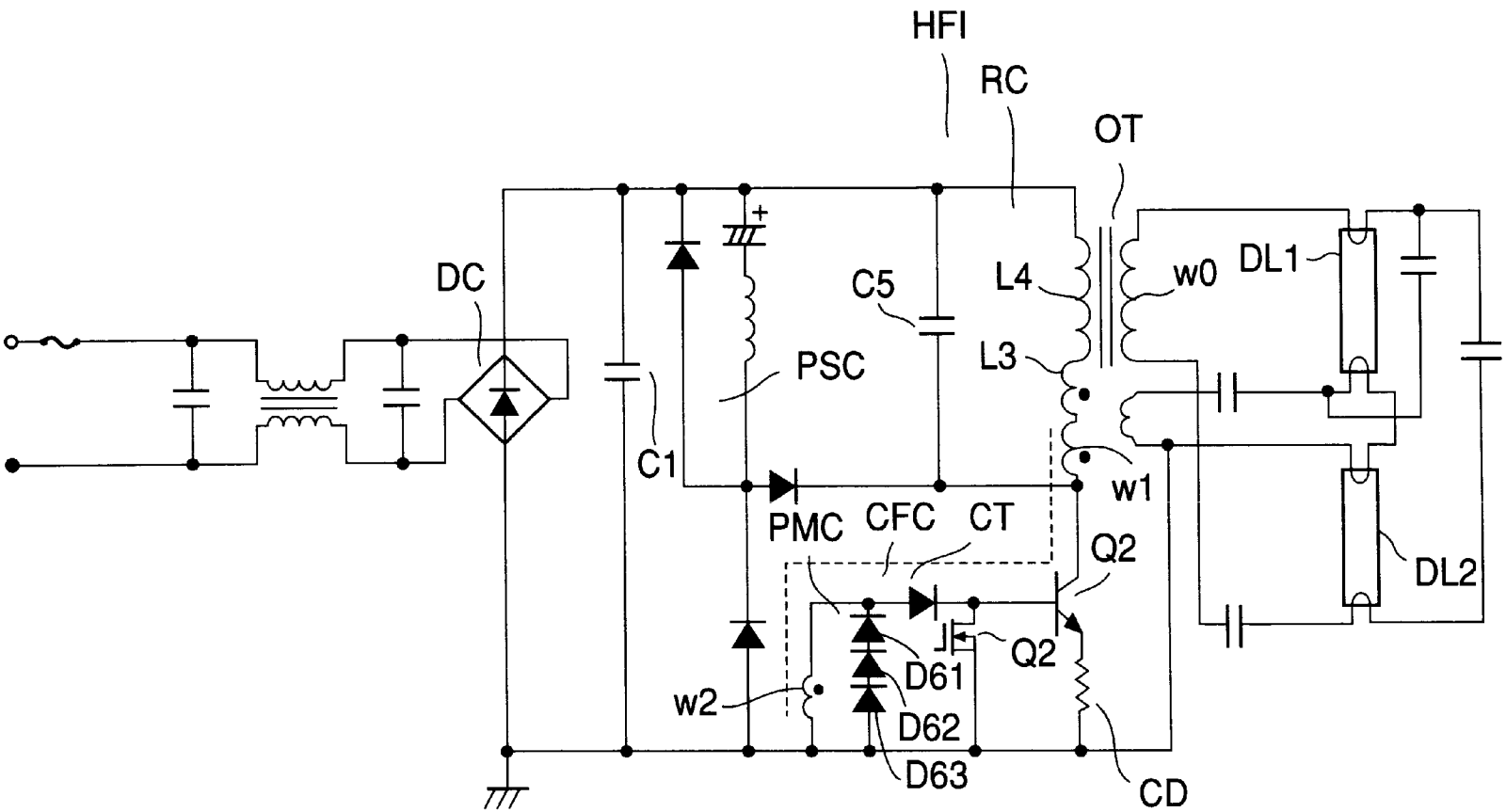
FIG. 9 is a circuit diagram showing the single-transistor voltage resonance inverter principally in the fifth embodiment of the discharge lamp lighting apparatus according to the present invention.

Next, referring to FIG. 9, the fourth embodiment of the discharge lamp lighting apparatus according to the present invention will be explained. FIG. 9 is a circuit diagram showing principally the single-transistor voltage resonance inverter in the forth embodiment of the discharge lamp lighting apparatus according to the present invention. In FIG. 9, the same elements as those, as shown in FIG. 7, are assigned with the same marks. This embodiment also has a diagram showing the current feedback circuit CFC different from the second embodiment as shown in FIG. 4.

That is, in the current feedback CFC, the primary winding w1 of the current transformer CTC is connected to the inductor L3 in series in the resonance circuit RC. The phase matching circuit PMC has a series circuit of two or more, for instance, three diodes D61, D62, and D63. The series diode circuit is coupled in parallel to the secondary winding w2 of the current transformer CT. In addition, the phase matching circuit PMC in the forth embodiment does not need the capacitor C14 which is coupled in series to the secondary winding w2 of the current transformer CT, as described in the second embodiment as shown in FIG. 4.

Figure 10:
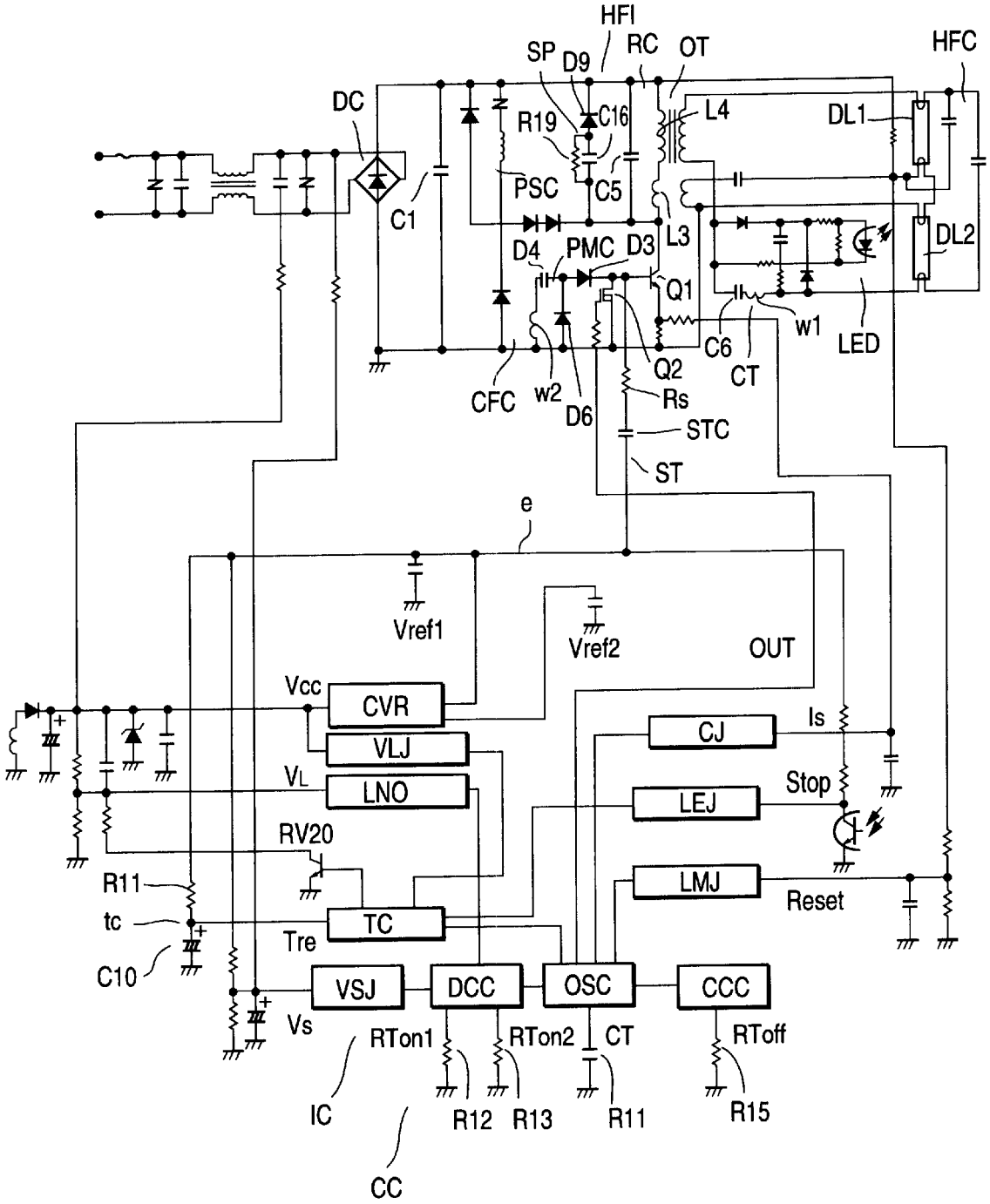
FIG. 10 is a circuit diagram showing the sixth embodiment of the discharge lamp lighting apparatus according to the present invention.
Figure 11:
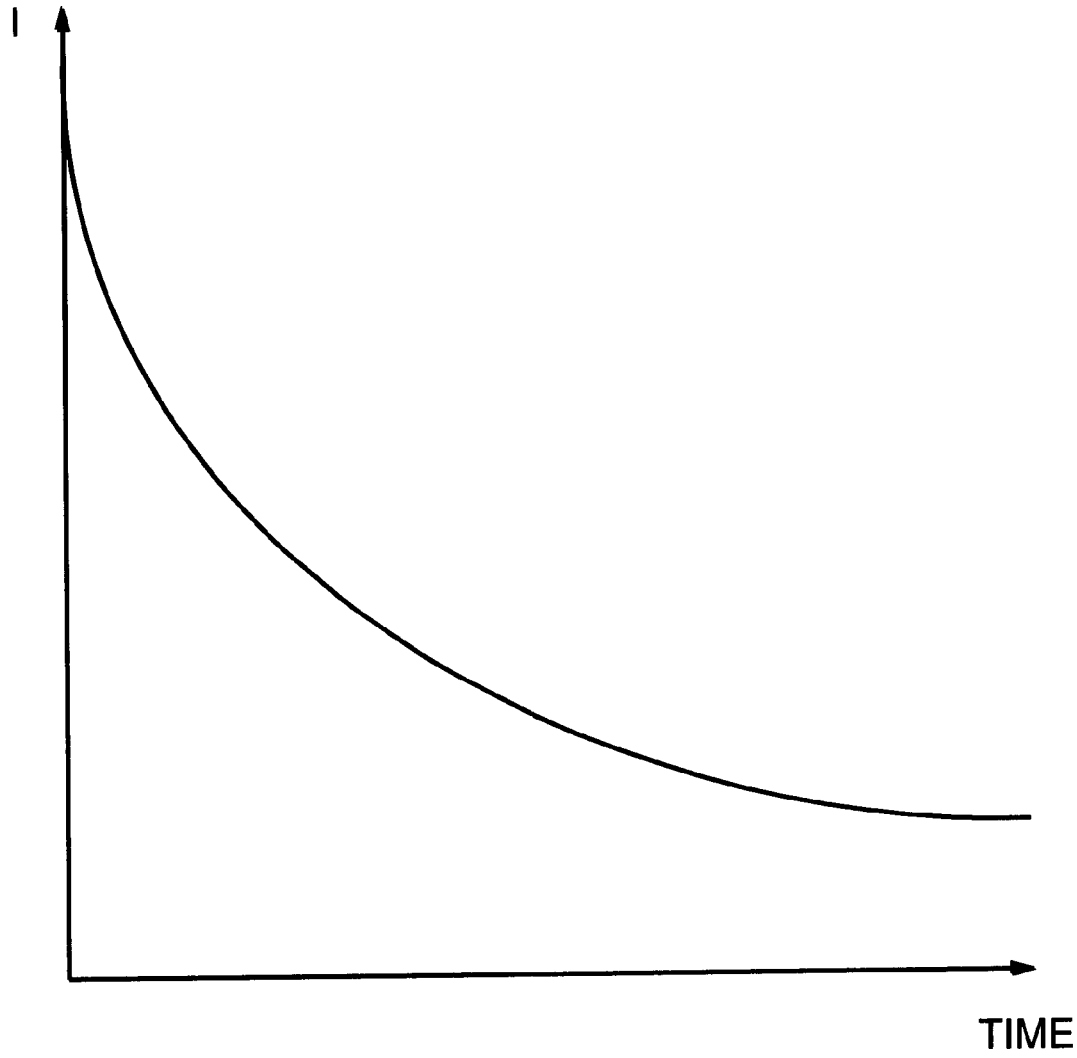
FIG. 11 is a graph showing the change of the starting current with time in the starting circuit ST in FIG. 10.
Figure 12A:
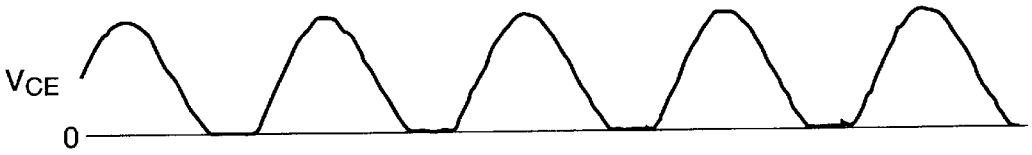
FIGS. 12*a* to 12*d* are waveform diagrams showing the waveforms of voltage and current of each part of the single-transistor voltage resonance inverter.
Figure 12B:
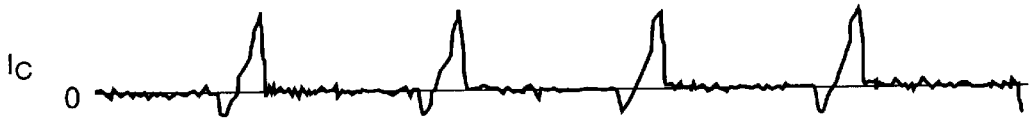
Figure 12C:
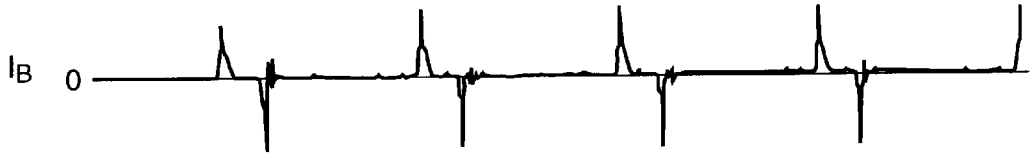
Figure 12D:
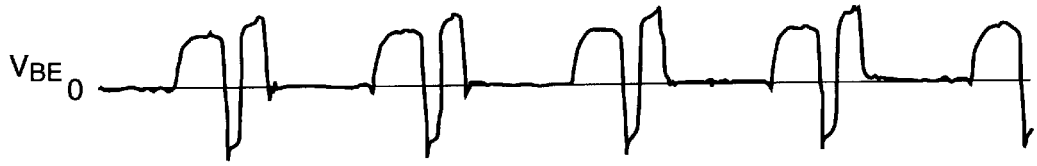
Figure 13:
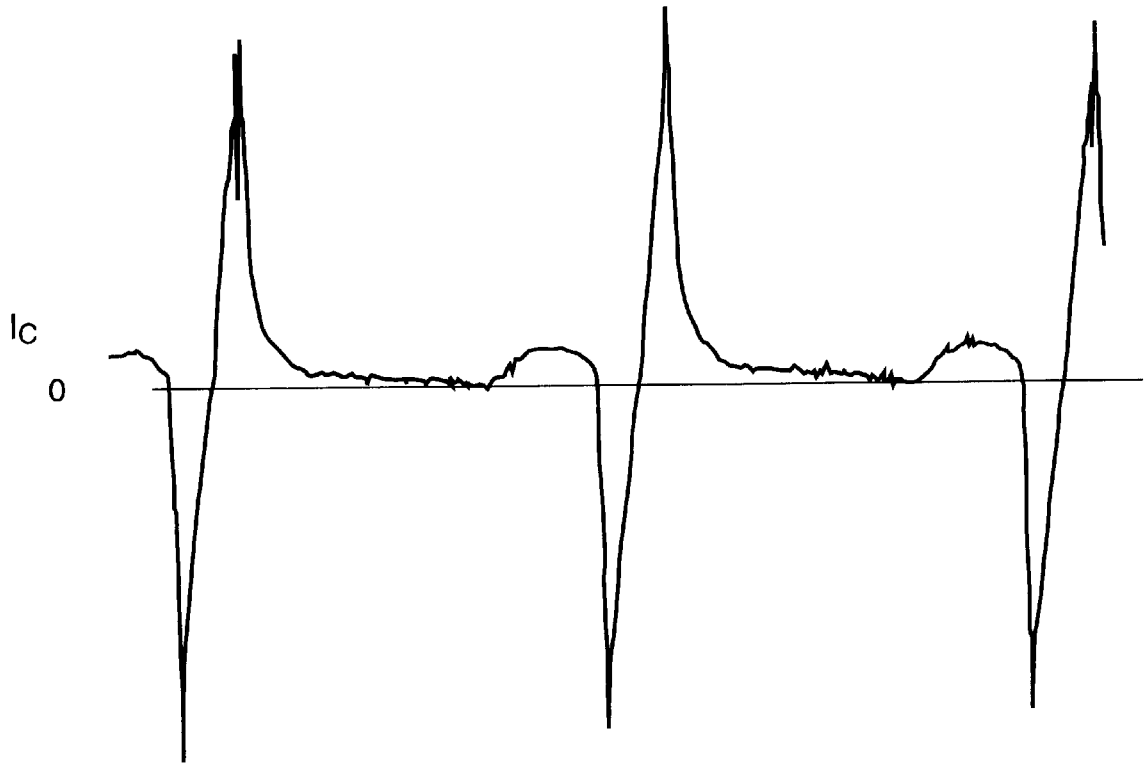
FIG. 13 is a waveform diagram showing the enlarged waveforms of the voltage across and through the collector-emitter VCE and the collector current IC.

Next, referring to FIGS. 10 and 11, the fifth embodiment of the discharge lamp lighting apparatus according to the present invention will be explained. FIG. 10 is a circuit diagram showing the fifth embodiment. A FIG. 11 is a graph showing the change of the starting current with time in a starting circuit ST shown in FIG. 10. In a FIG. 10, the same elements as those, as shown in FIG. 4, are assigned with the same marks and omitted the explanation. The fifth embodiment is provided with a starting circuit ST, different from other embodiments.

The starting circuit ST is provided with a starting current control STC and a starting resistor R9, and it is coupled in series between a terminal Vref for supplying the constant voltage power source e and a base of the bipolar transistor Q1. The constant voltage power source e is generated from a constant voltage source CVR in the integrated circuit IC. The starting current controller STC is provided with a differentiating circuit which is principally constituted by a capacitor. A starting resistor Rs limits a starting current.

When the integrated circuit IC of the control circuit CC is started by powering on a commercial AC power source, the reference voltage is output from the constant voltage power source e, and a starting current flows to the base of the bipolar transistor q1 via the starting current controller STC and the starting resistor Rs. Since the starting current controller STC performs the differential operation, the starting current is reduced with time goes, as shown in FIG. 11.

Figure 14:
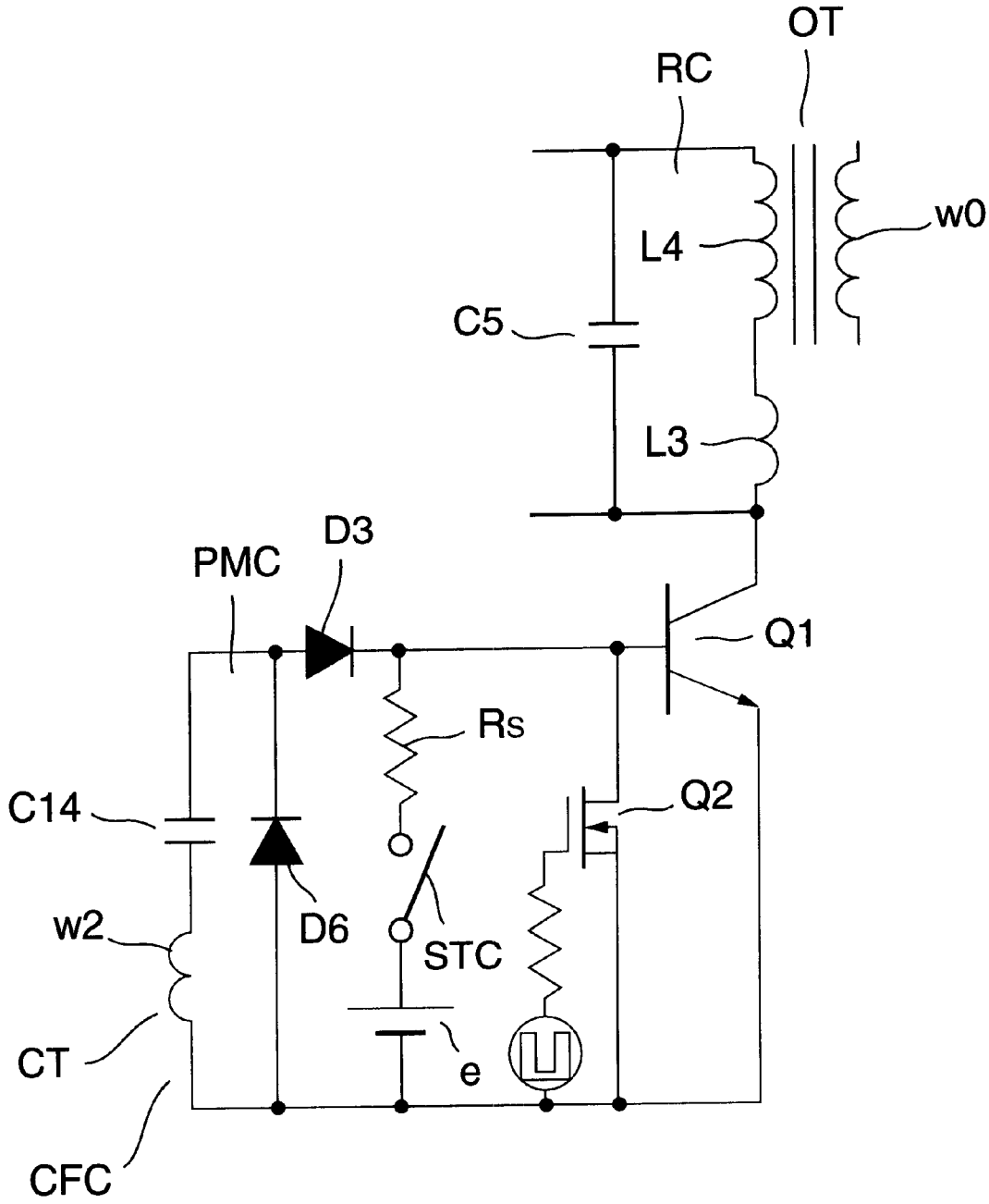
FIG. 14 is a circuit diagram showing the principal part in the seventh embodiment of the discharge lamp lighting apparatus according to the present invention.

FIG. 14 is a circuit diagram showing a principal part in the seventh embodiment of the discharge lamp lighting apparatus according to the present invention. In FIG. 14, the same elements as those shown in FIG. 10, are assigned with the same marks and omitted the explanation. The seventh embodiment is provided with a starting circuit ST different from other embodiments.

That is, the starting circuit ST is provided with a switch for performing a timer control to the starting current controller STC. The starting current controller STC flows the starting current to the base of the bipolar transistor Q1 by turned on at the predetermined timing, at the time of the starting operation of the single-transistor voltage resonance inverter, then it is turned off after predetermined time passes.

Figure 15:
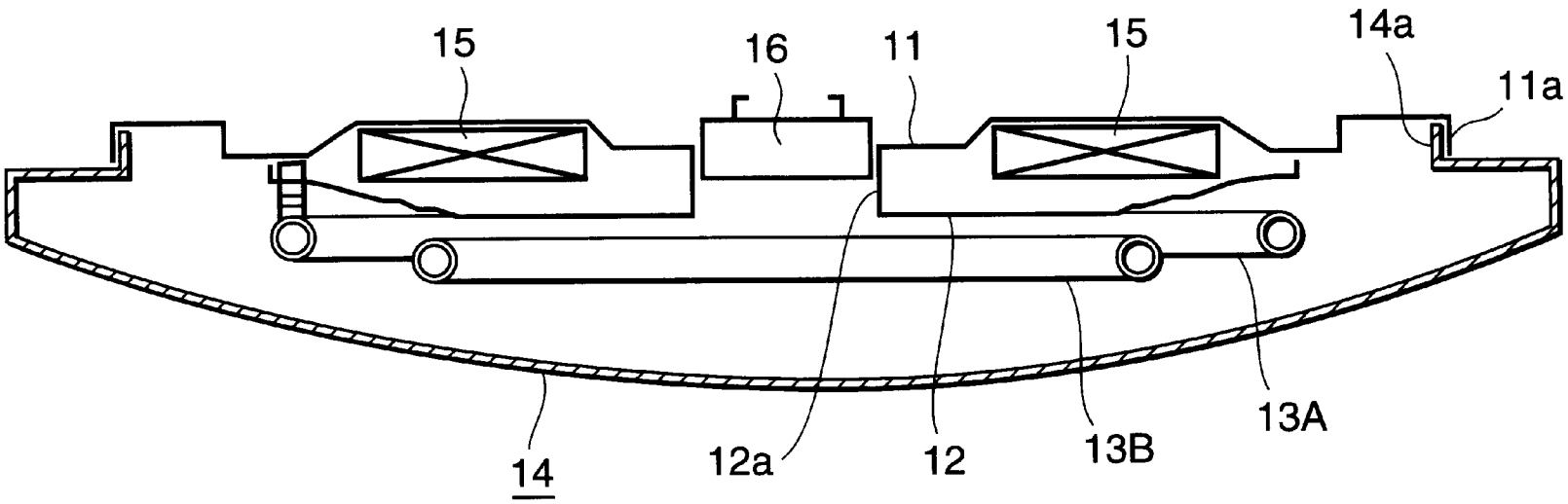
FIG. 15 is a conceptual sectional diagram showing a ceiling luminaire as one example of the luminaire according to the present invention.

FIG. 15 is a conceptual sectional showing a ceiling luminaire as one example of the luminaire according to the present invention.

In FIG. 15, 11 denotes a chassis, 12 denotes a reflection board, 13A and 13B denote annular fluorescent lamp, 14 denotes a shade, 15 denotes a high frequency lighting device, and 16 denotes a hang type ceiling adapter.

A chassis 11 is formed by press molding of the metal plate. A through hole is formed in the center of it, and a standing rim 11*a* (it is in a downward direction in the figure) around the periphery of it.

The reflection board 12 is made by forming a white synthetic resin, and it is mounted on the undersurface of the chassis 11.

The specification of the annulus fluorescence lamp 13A is having a tube diameter of 16.5 mm, an annulus outer diameter of, 373 mm, an annulus inner diameter of 340 mm, and a rated lamp electric of 34 w/48 w.

The specification of the annulus fluorescence lamp 13B is having a tube diameter of 16.5 mm, an annulus outer diameter of 225 mm, an annulus inner diameter of 192 mm, and a rated lap electric power of 20W/28W.

The annulus fluorescent lamps 13A and 13B is attachably installed on the predetermined position on the reflection board by lamp holders (not shown in figured). Further, when the lamps are installed on the position, the electronic connection is performed to the high frequency lighting device 15.

Shade 14 is make by shaping a milk-white acrylic resin to a thin dome to cover the chassis 11, the reflection board 12, and the annulus fluorescence lamps 13A and 13B, etc., and its opening rim 14*a* is fixed attachable to inside of the standing rim 11*a* of the chassis 11 by engaged.

The high frequency lighting device 15 is any of the device of first to sixth embodiments. It is lighted by biasing the annulus fluorescent lamps 13A and 13B, while it is installed on the space between the chassis 11 and the refraction board 12. Here, in the sectional diagram of FIG. 15, although the high frequency lighting device is shown by separated in two parts, these are two parts of one system.

The hang type ceiling adapter 16 has functions for supplying electrical energy to the ceiling luminaire by receiving the AC power source from the ceiling and for hanging the ceiling luminaire on the ceiling. Furthermore, the high frequency lighting device 15 is provided with a hanging ceiling cap 16*a*, an electric connector, and a hanging hook (both are not shown in figure).

The hanging ceiling cap 16*a* is hung on a recessed type or an open type hanging ceiling body mounted on the ceiling (not shown in figure) attachable, thus it is coupled to the ceiling body electrically and mechanically.

The electric connector is coupled to the hanging ceiling cap 16*a* via an insulated conductor. The electric connector is coupled to a power receiving plug mounted on the reflection board 12, thus the current supplying way to the ceiling luminaire is formed.

The hanging hook is retractably formed in the side of the hang type ceiling adapter 16, and it is engaged to an engaging hole formed on the wall of a cylindrical hole 12*a* which is defined in the center of the reflection board 12.

The procedure of attaching a sealing light on a ceiling will be described below.

The first step: The ceiling adapter 16 is hooked on the hang type ceiling body of the ceiling.

The second step: The cylindrical hole 12*a* is engaged in the hang type ceiling adapter 16, and an assembly of the chassis 11 and the reflection board 12 is stuck on the ceiling. In addition, The annulus fluorescent lamps 13A and 13B and shade 14 have not installed on yet.

In the adhesion procedure mentioned above, the assembly of the chassis 11 and the reflecting board 12 is pushed upward to the ceiling in the state that the hanging hook of the hang type ceiling adapter 16 slides over the side of the cylindrical hole 12*a*. When the hanging hook agree with an engaging hole, the engaging hole is pushed out by a spring mounted inside the hang type ceiling adapter 16 and engaged to the engaging hole. In this state, the assembly of the chassis 11 and the reflecting board 12 is fixed to the ceiling via the hang type ceiling adapter 16 and the hang type ceiling body.

The third step: The electric connector is coupled to the power receiving plug of the reflecting board 12.

The fourth step: The annulus fluorescent lamps 13A and 13B are engaged in the lamp holder mounted on the predetermined position of the reflecting board 12. Here, the mechanical installation and the electrical connection of the annulus fluorescent lamps 13A and 13B are performed in one operation.

The fifth steps: Finally, the opening rim 14*a* of the shade 14 is engaged in the inside the standing rim 11*a* of the chassis 11, so as to rotate the shade 14. According to the rotation, the opening rim 14*a* of the shade 14 is fixed on the hanging hook mounted on the chassis 11. Thus, the attachment of the ceiling luminaire is completed.

While there have been illustrated and described what are at present considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation or material to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

The foregoing description and the drawings are regarded by the applicant as including a variety of individually inventive concepts, some of which may lie partially or wholly outside the scope of some or all of the following claims. The fact that the applicant has chosen at the time of filing of the present application to restrict the claimed scope of protection in accordance with the following claims is not to be taken as a disclaimer or alternative inventive concepts that are included in the contents of the application and could be defined by claims differing in scope from the following claims, which different claims may be adopted subsequently during prosecution, for example, for the purposes of a divisional application.

What is claimed is:

1. A discharge lamp lighting apparatus, comprising:

a DC power supply, generating a direct current voltage;

an inverter circuit, switching the direct current voltage at a high frequency, and including one bipolar transistor, which is turned on by a feedback signal of the high frequency voltage and turned off by an off-switching signal of a control circuit, and a resonance circuit resonated by the switching operations;

a discharge lamp, operated by the high frequency voltage; and the control circuit, provided with a timer, which determines operation-durations including a preheating mode, a starting mode and a lighting mode of the discharge lamp, and an oscillator generating the off-switching signal according to the each mode.

2. A discharge lamp lighting apparatus, comprising:

a DC power supply, generating a direct current voltage;

an inverter circuit, switching the direct current voltage at a high frequency, and including one bipolar transistor, which is turned on by a feedback signal of the high frequency voltage and turned off by an off-switching signal of a control circuit, and a resonance circuit resonated by the switching operations;

a discharge lamp, operated by the high frequency voltage;

a current transformer, feeding back a lamp current of the discharge lamp to turn on the bipolar transistor;

a base current cut-off device responsive to the off-switching signal of the control circuit to cut off a base current of the bipolar transistor; and the control circuit, provided with a timer and an oscillator, wherein the timer determines operation-durations including a preheating mode, a starting mode and a lighting mode of the discharge lamp, and supplies a starting current to the bipolar transistor, and the oscillator provides the base current cut-off device with the off-switching signal which varies to regulate an on-duration of the base current cut-off device according to the each mode.

3. A discharge lamp lighting apparatus, comprising:

a first DC power supply, generating a first direct current voltage;

an inverter circuit, switching the first direct current voltage at a high frequency, and including one bipolar transistor, which is turned on by a feedback signal of the high frequency voltage and turned off by an off-switching signal of a control circuit, and a resonance circuit resonated by the switching operations;

a discharge lamp, operated by the high frequency voltage;

a base current cut-off device responsive to the off-switching signal of the control circuit to cut off a base current of the bipolar transistor;

a starting current controller, controlling a second direct current voltage supplied from a second DC power supply provided in the control circuit to the base of the bipolar transistor for a predetermined period in a starting operation; and the control circuit, provided with an oscillator defining the high frequency for operating the inverter and regulating the frequency of the off-switching signal.

4. A discharge lamp lighting apparatus, comprising:

a DC power supply, generating a direct current voltage;

an inverter circuit, switching the direct current voltage at a high frequency, and including one bipolar transistor, which is turned on by a feedback signal of the high frequency voltage and turned off by an off-switching signal of a control circuit, and a resonance circuit resonated by the switching operations;

a discharge lamp, operated by the high frequency voltage; and the control circuit, provided with a timer regulating operation modes of the discharge lamp, and an oscillator generating the off-switching signal according to each operation mode of the discharge lamp.

5. A discharge lamp lighting apparatus as claimed in claim 4, wherein the control circuit is provided with:

a lamp life terminal detecting circuit for detecting the life terminal of the discharge lamp;

a lamp installation detecting circuit for detecting the installation of the discharge lamp;

a lamp life terminal determining circuit for determining the life terminal in response to the output of the lamp life terminal detecting circuit;

a lamp installation determining circuit for determining the lamp installation in response to the output of the lamp installation detecting circuit; and wherein it is characterized by that the control circuit carries out a protective action when a lamp life terminal is determined, and releases the protective action when a lamp installation is determined.

6. A discharge lamp lighting apparatus as claimed in claim 4, wherein the off-switching signal consists of an on-duration and an off-duration, and wherein the control circuit controls a frequency of the off-switching signal by regulating the off-duration of the off-switching signal while leaving the on-duration of the off-switching signal constant.

7. A discharge lamp lighting apparatus as claimed in claim 4, wherein the frequency of the off-switching signal is determined by an external device to the control circuit.

8. A discharge lamp lighting apparatus, comprising:

a DC power supply, generating a direct current voltage;

an inverter circuit, switching the direct current voltage at a high frequency, and including one bipolar transistor, which is turned on by a feedback signal of the high frequency voltage and turned off by an off-switching signal of a control circuit, and a resonance circuit resonated by the switching operations;

a discharge lamp, operated by the high frequency voltage;

a current transformer, having a primary winding of the transformer inserted in a current path of the discharge lamp and a secondary winding inserted in a base current path of the bipolar transistor, thereby feeding back a lamp current of the discharge lamp to the base of the bipolar transistor to turn on the bipolar transistor through the primary winding and the secondary winding;

a base current cut-off device responsive to the off-switching signal of the control circuit to cut off a base current of the bipolar transistor; and the control circuit, provided with a timer regulating operation modes of the discharge lamp, and an oscillator providing the base current cut-off device with the off-switching signal which varies in its frequency to regulate an on-duration of the base current cut-off device according to the operation mode of the discharge lamp.

9. A luminaire, comprising:

a body; and a discharge lamp lighting apparatus, as claimed in claim 4, mounted on the body.

* * * * *